US006767190B2

(12) United States Patent
Cabuz et al.

(10) Patent No.: US 6,767,190 B2
(45) Date of Patent: Jul. 27, 2004

(54) METHODS OF OPERATING AN ELECTROSTATICALLY ACTUATED PUMP

(75) Inventors: Eugen I. Cabuz, Edina, MN (US); Cleopatra Cabuz, Edina, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/374,294

(22) Filed: Feb. 25, 2003

(65) Prior Publication Data

US 2003/0129064 A1 Jul. 10, 2003

Related U.S. Application Data

(62) Division of application No. 09/974,413, filed on Oct. 9, 2001.

(51) Int. Cl.[7] ..... F04B 1/00

(52) U.S. Cl. ..... 417/53; 417/322; 417/413.1; 417/413.2; 417/413.3; 417/349

(58) Field of Search ..... 417/322, 413.1, 417/413.2, 413.3, 349, 479, 53

(56) References Cited

U.S. PATENT DOCUMENTS

| | | | |
|---|---|---|---|
| 2,403,692 | A | 7/1946 | Tibbetts |
| 2,975,307 | A | 3/1961 | Shroeder et al. |
| 3,304,446 | A | 2/1967 | Martinek et al. |
| 3,381,623 | A | 5/1968 | Elliot |

(List continued on next page.)

FOREIGN PATENT DOCUMENTS

| | | |
|---|---|---|
| DE | 19617852 | 1/1993 |
| EP | 0744821 A2 | 11/1996 |
| EP | 0744821 A3 | 12/1996 |
| JP | 05-219760 | 8/1993 |
| JP | 02-86258 | 10/1995 |
| SU | 744877 | 6/1980 |
| WO | WO 0028215 | 5/2000 |
| WO | WO 0133078 | 5/2001 |

OTHER PUBLICATIONS

B. Halg, "On a Nonvolatile Memory Cell Based on Micro–Electro–Mechanics", Proceedings of MEMS CH2832–4/90/0000–0172 IEEE (1990), pp. 172–176.

Bertz, Schubert, Werner, "Silicon Grooves With Sidewall Angles Down to 1° made By Dry Etching", pp. 331–339.

Branebjerg, Gravesen, "A New Electrostatic Actuator Providing Improved Stroke Length and Force." Micro Elctro Mechanical Systems '92 (Feb. 4–7, 1992), pp. 6–11.

Bustgens, Bacher, Menz, Schomburg, "Micropump Manufactured by Thermoplastic Molding" MEMS 1994, pp. 18–21.

(List continued on next page.)

*Primary Examiner*—Justine R. Yu
*Assistant Examiner*—Emmanuel Sayoc
(74) *Attorney, Agent, or Firm*—Matthew Luxton; Brian N. Tufte

(57) ABSTRACT

Methods and apparatus for electrostatically pumping fluids without passing the fluids through the electric field of the pump are contemplated. Electrostatic forces are preferably used to move the diaphragms in one direction, while elastic and/or other restorative forces are used to move the diaphragms back to their original un-activated positions. In some embodiments, this may allow fluid to be pumped without passing the fluid between actuating electrodes. This may be particularly useful when the fluids have dielectric, conductive, polar or other qualities that may affect traditional electrostatic pump performance. Pumps having various elementary cells are contemplated, including two-celled pumps disposed within a single chamber and pumps having greater numbers of cells wherein each cell is disposed within a different chamber.

15 Claims, 16 Drawing Sheets

U.S. PATENT DOCUMENTS 3,641,373 A 2/1972 Elkuch
3,769,531 A 10/1973 Elkuch
3,803,424 A 4/1974 Smiley et al.
3,947,644 A 3/1976 Uchikawa
4,115,036 A 9/1978 Paterson
4,140,936 A 2/1979 Bullock
4,197,737 A 4/1980 Pittman
4,453,169 A 6/1984 Martner ..... 346/140
4,478,076 A 10/1984 Bohrer
4,478,077 A 10/1984 Boher
4,498,850 A 2/1985 Perlov et al.
4,501,144 A 2/1985 Higashi et al.
4,539,575 A 9/1985 Nilsson
4,576,050 A 3/1986 Lambert
4,651,564 A 3/1987 Johnson et al.
4,654,546 A 3/1987 Kirjavainen
4,756,508 A 7/1988 Giachino et al.
4,821,999 A 4/1989 Ohtaka
4,911,616 A 3/1990 Laumann, Jr.
4,938,742 A 7/1990 Smits
4,939,405 A 7/1990 Okuyama et al.
5,065,978 A 11/1991 Albarda et al.
5,069,419 A 12/1991 Jerman
5,078,581 A 1/1992 Blum et al.
5,082,242 A 1/1992 Bonne et al.
5,085,562 A 2/1992 van Lintel
5,096,388 A 3/1992 Weinberg
5,129,794 A 7/1992 Beatty
5,148,074 A 9/1992 Fujita et al.
5,171,132 A 12/1992 Miyazaki et al.
5,176,358 A 1/1993 Bonne et al.
5,180,288 A 1/1993 Richter et al.
5,180,623 A 1/1993 Ohnstein
5,192,197 A 3/1993 Culp
5,206,557 A 4/1993 Bobbio
5,219,278 A 6/1993 van Lintel
5,224,843 A 7/1993 van Lintel
5,244,527 A 9/1993 Aoyagi
5,244,537 A 9/1993 Ohnstein
5,322,258 A 6/1994 Bosch et al.
5,323,999 A 6/1994 Bonne et al.
5,441,597 A 8/1995 Bonne et al.
5,452,878 A 9/1995 Gravesen et al.
5,499,909 A 3/1996 Yamada et al.
5,541,465 A 7/1996 Higuchi et al.
5,542,821 A * 8/1996 Dugan ..... 417/53
5,552,654 A 9/1996 Konno et al.
5,571,401 A 11/1996 Lewis et al.
5,642,015 A 6/1997 Whitehead et al.
5,683,159 A 11/1997 Johnson
5,725,363 A 3/1998 Bustgens et al.
5,759,014 A 6/1998 Van Lintel
5,759,015 A 6/1998 Van Lintel et al.
5,836,750 A * 11/1998 Cabuz ..... 417/322
5,863,708 A 1/1999 Zanzucchi et al.
5,901,939 A 5/1999 Cabuz et al.
5,911,872 A 6/1999 Lewis et al.
6,106,245 A 8/2000 Cabuz
6,179,586 B1 1/2001 Herb et al.
6,184,607 B1 2/2001 Cabuz et al.
6,215,221 B1 4/2001 Cabuz et al.
6,450,773 B1 * 9/2002 Upton ..... 417/53
6,508,528 B2 * 1/2003 Fujii et al. ..... 347/9
6,520,753 B1 * 2/2003 Grosjean et al. ..... 417/379
6,579,068 B2 * 6/2003 Bridger et al. ..... 417/53
2002/0067992 A1 * 6/2002 Bridger et al. ..... 417/53

OTHER PUBLICATIONS

C. Cabuz, et al., "High Reliability Touch–Mode Electrostatic Actuators", Technical Digest of the Solid State Sensor and Actuator Workshop, Hilton Head, S.C., Jun. 8–11, 1998, pp. 296–299.

C. Cabuz. Tradeoffs in MOEMS Material: Proceedings of the SPIE, vol. 2881, pp. 160–170, Austin, TX., Jul. 1996.

Minami K et al., "Fabrication of Distributed Electrostatic Micro Actuator (DEMA)" Journal of Microelectromechanical Systems, US, IEEE Inc., New York, vol. 2, No. 3, Sep. 1, 1993, pp. 121–127, XP000426532, ISSN: 1057–7157.

"Large–Scale Linearization Circuit For Electrostatic Motors" IBM Technical Disclosure Bulletin, US. IBM Corp. New York, vol. 37, No. 10, Oct. 1, 1994, pp. 563–564, XP000475777, ISN: 0018–8689.

Srinivasan et al., "Self–Assembled Flurocarbon Films for Enhanced Stiction Reduction", TRANSDUCERS '97, 1997 International Conference on Solid–State Sensors and Actuators, Chicago, Jun. 16–19, 1997, pp. 1399–1402.

Shikida, Sato, "Characteristics of an Electrostatically–Driven Gas Valve Under High Pressure Conditions, IEEE 1994, pp. 235–240."

Shikida, Sato, Harada, "Fabrication of An S–Shaped Microactuator," Journal of Microelectromechanical Systems, vol. 6, No. 1 (Mar. 1997), pp. 18–24.

Shikida, Sato, Tanaka, Kawamura, Fujisaki, "Electrostatically Driven Gas Valve With High Conductance", Journal of Microelectromechanical Systems, vol. 3, No. 2 (Jun. 1994), pp. 76–80.

Wagner, Quenzer, Hoerscelmann, Lisec, Juerss, "Bistable Microvalve with Pneumatically Coupled Membranes," 0–7803–2985–6/96, IEEE (1996), pp. 384–388.

Jye–Shane Yang et al., "Fluorescent Porous Polymer Films as TNT Chemosensors: Electronic and Structural Effects", *J. Am. Chem. Soc.*, 1998, 120, pp. 11864–11873.

Jye–Shane Yang et al., "Porous Shape Persistent Fluorescent Polymer Films: An Approach to TNT Sensory Materials", *J. Am. Chem. Soc.*, 1998, 120, pp. 5321–5322.

Michael S. Freund et al., "A Chemically Diverse Conducting 'Polymer–Based Electronic Nose'", Proceedings of the National Academy of Sciences of the United States of America, vol. 92, No. 7, Mar. 28, 1995, pp. 2652–2656.

Porex Technologies, brochure, dated prior to Jun. 2, 2000, 4 pages.

* cited by examiner

METHODS OF OPERATING AN ELECTROSTATICALLY ACTUATED PUMP

CROSS REFERENCE TO RELATED APPLICATION

This application is a divisional of U.S. patent application Ser. No. 09/974,413, filed Oct. 9, 2001.

FIELD OF THE INVENTION

The present invention relates to an electrostatic pump, and more specifically, to electrostatic pumps that use an electrostatically actuated diaphragm to pump fluids.

BACKGROUND OF THE INVENTION

Some industrial, commercial, aerospace and military systems depend critically on reliable pumps for fluid (including gas) handling. Among recent trends in the art of pumping fluids is the increasing use of micro- and meso-pumps. Micro- or meso-pumps are relatively small devices that often use an electrostatic force to move pump walls or diaphragms. The electrostatic force is often applied by applying a voltage between two paired electrodes, which are commonly attached to selected pump walls and/or diaphragms. The electrostatic force results in an attractive force between the paired electrodes, which moves the selected pump walls or diaphragms toward one another resulting in a pumping action.

A limitation of many such devices is that the fluid being pumped often moves between the paired electrodes. The dielectric, conductive, polar or other properties of the pumped fluid can affect the performance of the pump, and in particular, the electrostatic force between the paired electrodes. This may reduce the efficiency and/or reliability of the pump. In addition, the electric field applied between the paired electrodes can impact or change the properties of the fluid being pumped. This may be undesirable in some applications. For these and other reasons, it would be desirable to provide a electrostatically actuated pump that avoids passing the fluid through the electric field of the pump.

SUMMARY OF THE INVENTION

The present invention includes methods and devices for electrostatically pumping fluids without passing the fluids through the electric field of the pump. In one illustrative embodiment, this is accomplished by providing an elastic diaphragm within a pumping chamber of an elementary pumping cell. A first side of the diaphragm may be exposed to the fluid during pumping, while the other side may be positioned adjacent a stationary electrode that, in an illustrative embodiment, is mounted on or near the opposite chamber wall. The diaphragm preferably has an electrode that is in registration with the stationary electrode.

During use, the diaphragm is preferably deflected toward the stationary electrode via an electrostatic force between the stationary electrode and the electrode on the diaphragm. In one illustrative embodiment, this draws the pump fluid from an inlet port of the pumping chamber along the first side of the diaphragm. When the electrostatic force is removed, the restoring elastic force of the diaphragm may push the fluid drawn into the pumping chamber through an outlet port in the pumping chamber. This may be repeated to provide a continuous pumping action, if desired. In some embodiments, check valves may be provided on the inlet and/or outlet ports to enhance the pumping action. Such check valves may be provided separately, or by the diaphragm if desired. Some other embodiments perform pumping action without a need for check valves, which can be difficult to design and operate at low flows or low pressures.

In another illustrative embodiment, two or more of the elementary pumping cells discussed above may be used in concert to provide a pumping action. In this embodiment, an elementary pumping cell may include two pumping chambers separated by a separating wall. The two pumping chambers are preferably in fluid communication with one another through a port in the separating wall. Each of the pumping chambers preferably has an elastic diaphragm that lies along the separating wall in an un-activated state.

Like above, each diaphragm preferably has an electrode that is separated from a stationary electrode, which in an illustrative embodiment, is mounted on or near the opposite wall of the corresponding pumping chamber. To help improve the efficiency and/or operation of the pump, it is contemplated that the opposite wall of each pumping chamber may be curved so that the stationary electrode is located closer to the electrode on the corresponding diaphragm near the edges of the pumping chamber, if desired.

During use, a voltage may be applied between the stationary electrode of a first one of the two pumping chambers and the electrode of the corresponding first diaphragm. This deflects the first diaphragm toward the stationary electrode of the first pumping chamber via an electrostatic force, which in the illustrative embodiment, causes the pump fluid to be drawn into the first pumping chamber between the first diaphragm and the separating wall. At the same time, a similar voltage may not be applied between the stationary electrode of the second pumping chamber and the electrode on the second diaphragm. The restoring elastic force of the second diaphragm then closes the port between the two pumping chambers.

Next, a voltage may be applied between the stationary electrode of the second pumping chamber and the electrode of the second diaphragm. This deflects the second diaphragm toward the stationary electrode of the second pumping chamber via an electrostatic force, causing the pump fluid to be drawn through the port in the separating wall and into the second pumping chamber between the second diaphragm and the separating wall. At the same time, the voltage between the stationary electrode of the first pumping chamber and the electrode on the first diaphragm may be reduced or eliminated. The restoring elastic force of the first diaphragm may help push the fluid through the port in the separating wall, and into the second pumping chamber. The movement of the first diaphragm may also close the inlet port of the first pumping chamber.

Next, the voltage between the stationary electrode of the second pumping chamber and the electrode of the second diaphragm may be reduced or eliminated. This may cause the restoring elastic force of the second diaphragm to push the fluid through an outlet port of the second pumping chamber. The elastic force of the first diaphragm may help keep the port in the separating wall closed. This sequence may be repeated to provide a continuous pumping action. It is contemplated that multiple elementary pumping cells may be used together in a similar way, if desired. In addition, various other embodiments are contemplated for pumping fluids without passing the fluids through the electric field of the pump, some of which are described below.

DETAILED DESCRIPTION OF THE PREFERRED EMBODIMENTS

Figure 1:
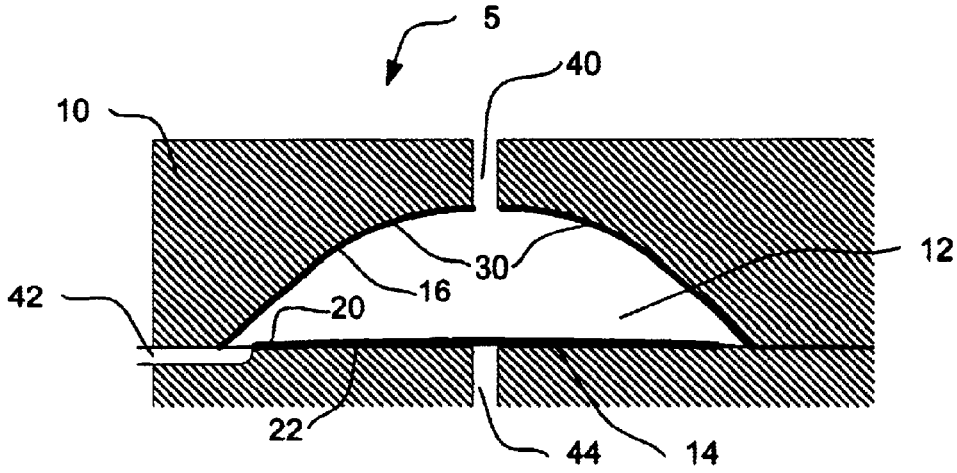
FIG. 1 is a cross-sectional side view of an illustrative elementary cell, with a diaphragm positioned adjacent a first wall.

The following description should be read with reference to the drawings wherein like reference numerals indicate like elements throughout the several views. The detailed description and drawings are presented to show embodiments that are illustrative of the claimed invention.

FIG. 1 is a cross-sectional side view of an illustrative elementary pumping cell 5. The illustrative elementary pumping cell 5 has a body 10 with a first opposing wall 14 and a second opposing wall 16 that define a pumping chamber 12. An inlet port 42 extends into the pumping chamber 12, as shown. An outlet port 44 extends from the pumping chamber 12, preferably through the first opposing wall 14. A back pressure conduit 40 may extend from the pumping chamber 12 through the second opposing wall 16.

An elastic diaphragm 20 is positioned within the pumping chamber 12. In the illustrative embodiment, the elastic diaphragm extends along the first opposing wall 14 in the un-activated state, as shown. Diaphragm 20 preferably includes one or more electrodes, such as electrode 22. The electrode 22 preferably extends to at least near the edges of the pumping chamber 12, and in some embodiments, can extend outside of the chamber.

The second opposing wall 16 preferably includes one or more stationary electrodes, such as electrodes 30. The second opposing wall 16 and the diaphragm 20 are preferably configured so that, in the un-activated state, the separation distance between the stationary electrodes 30 and the electrode 22 on the diaphragm is smaller near the edges of the pumping chamber 12. This may help draw the diaphragm 20 toward the second opposing wall 16 in a rolling action when a voltage is applied between the electrodes 22 and 30. Such a rolling action may help improve the efficiency and reduce the voltage requirements of the pump.

For purposes of illustration, the first opposing wall 14 is shown to be generally flat. However, the first opposing wall 14 may assume other shapes, depending upon the application. For example, the first opposing wall 14 may have different regions that are recessed or protrude against the diaphragm 20 in order to, for example, prevent the diaphragm 20 from achieving a suction lock against the first opposing wall 14, or to improve the backflow capabilities of the pump 5. Other shapes may also be used, including curved shapes, if desired. Although the second opposing wall 16 is shown to be generally curved, other shapes may be used, depending on the application.

Body 10 may be made from any suitable semi-rigid or rigid material, such as plastic, ceramic, silicon, etc. Preferably, however, the body 10 is constructed by molding a high temperature plastic such as ULTEM™ (available from General Electric Company, Pittsfield, Mass.), CELAZOLE™ (available from Hoechst-Celanese Corporation, Summit, N.J.), KETRON™ (available from Polymer Corporation, Reading, Pa.), or some other suitable plastic material. Diaphragm 20 may be made from any suitable material, preferably having elastic, resilient, flexible or other elastomeric property. In a preferred embodiment, the diaphragm 20 is made from a polymer such as KAPTON™ (available from E. I. du Pont de Nemours & Co., Wilmington, Del.), KALADEX™ (available from ICI Films, Wilmington, Del.), MYLAR™ (available from E. I. du Pont de Nemours & Co., Wilmington, Del.), or any other suitable material.

Electrode 22 is preferably provided by patterning a conductive coating on the diaphragm 20. For example, electrode 22 may be formed by printing, plating or EB deposition of metal. In some cases, the electrode layer may be patterned using a dry film resist, as is known in the art. The same or similar techniques may be used to provide the electrode 30 on the second opposing wall 16 of the body 10. Rather than providing a separate electrode layer, it is contemplated that the diaphragm 20 and/or second opposing wall 16 may be made conductive so as to function as an electrode, if desired.

A dielectric, such as a low temperature organic and inorganic dielectric, may be used as an insulator between the actuating electrodes 22 and 30. The dielectric may be coated over the electrode 22, electrode 30, or both. An advantage of using a polymer based substrate and/or diaphragm is that the resulting pumps may be made cheaper and lighter, and/or suitable for small handheld, or even suitable for disposable or reusable applications.

Figure 2:
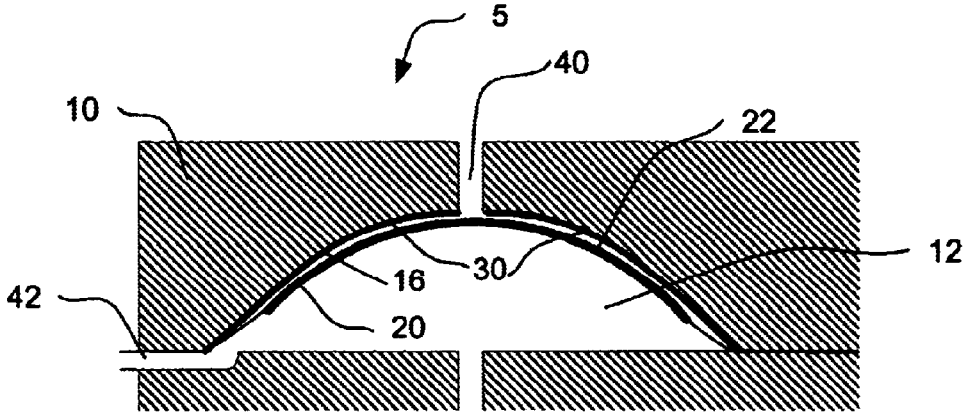
FIG. 2 is a cross-sectional side view of the illustrative elementary cell of FIG. 1 with the diaphragm deformed and positioned adjacent a second opposite wall.

FIG. 2 is a cross-sectional side view of the elementary cell 5 of FIG. 1, with the diaphragm 20 pulled toward the second opposing wall 16. For the purposes of illustration, the diaphragm 20 is shown at some distance from second opposing wall 16. Preferably, however, the diaphragm 20 is pulled to conform to the second opposing wall 16. In some embodiments, the degree of conformity of the diaphragm 20 to the second opposing wall 16 may be limited by physical constraints, or even manipulated during pump operation to change the output rate or volume. Such manipulation can be performed by, for example, adjusting the tension at which the diaphragm 20 is disposed (when a diaphragm 20 is disposed under tension), adjusting the back pressure through the back pressure conduit 40, adjusting the level of voltage applied between the electrodes 22 and 30, or other methods that reduce or increase the net force applied to the diaphragm 20 as it deflects toward the second opposing wall 16.

As indicated above, the diaphragm 20 may be disposed across the pumping cavity 12 under tension. Alternatively, or in addition, the diaphragm 20 may be of a material with a preformed shape to which the diaphragm 20 elastically returns after application of a deforming force. In either case, the diaphragm 20 may be of a material, form, or disposed in a fashion such that the diaphragm 20, once deformed as shown in FIG. 2, generates a restoring force that pulls the diaphragm 20 back towards the first opposing wall 14, such as shown in FIG. 1.

Preferably, a force is exerted between the diaphragm 20 and the second opposing wall 16 by applying a voltage between the electrodes 22 and 30. Such a voltage creates an attractive electrostatic force between the electrodes 22 and 30. The electrostatic force may be of varying strength, but preferably it is sufficient to cause the diaphragm 20 to be deformed toward the second opposing wall 16, and more preferably, so that the diaphragm engages the second opposing wall 16. When the voltage is reduced or terminated, the restoring force of the diaphragm 20 preferably pulls the diaphragm 20 back toward the first opposing wall 14, and preferably adjacent to the first opposing wall 14 as shown in FIG. 1.

It is contemplated that supplemental restoring forces may be provided to help restore the diaphragm 20 to its un-activated state. For example, like charges may be applied to both electrodes 22 and 30, creating a repelling electrostatic force therebetween. This repelling electrostatic force may help push the diaphragm 20 back toward the first opposing wall 14. Alternatively, or in addition, supplemental restoring forces may be created by applying back pressure to the diaphragm 20 through back pressure conduit 40, such as explained below with respect to FIG. 8.

In another illustrative embodiment, the position of the diaphragm 20 shown in FIG. 2 may be the "default" or un-activated position to, which the diaphragm 20 returns after a deforming force is exerted. In this alternative embodiment, the diaphragm 20 is deformed to be adjacent the first opposing wall 14 when an electrostatic force is exerted on the diaphragm 20. Such a force may be created by, for example, applying like charges to both electrodes 22 and 30, creating a repelling electrostatic force. Alternatively, or in addition, the displacing force may be created by applying greater back pressure to the diaphragm 20 through back pressure conduit 40, such as explained below with respect to FIG. 8.

Another illustrative embodiment of the present invention uses a diaphragm 20 that is made from a generally compliant material. In this embodiment, the electrodes 22 and 30 are used to cause actuation of the diaphragm in both directions, by first applying a voltage differential to the electrodes 22 and 30, which causes the diaphragm to assume the shape shown in FIG. 2, and then applying similar charges to each, generating a repellant electrostatic force which causes the diaphragm 20 to assume the shape shown in FIG. 1.

Several illustrative types of actuating and restoring forces are disclosed. It is contemplated that these forces and others may be used in appropriate combinations, including back pressure or suction, varying pressure or suction, tension, elastic restorative forces, electrostatic repulsion, electrostatic attraction, etc.

Figure 3:
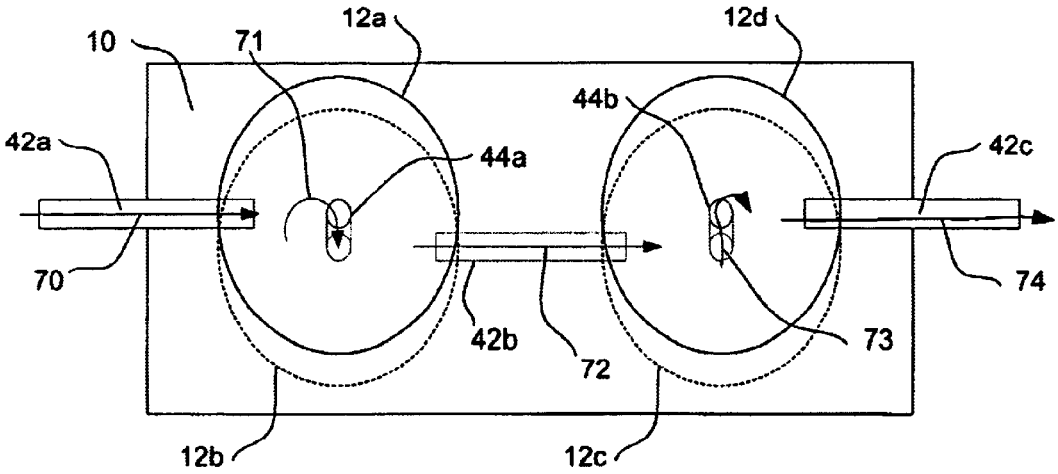
FIG. 3 is a partial cross-sectional top view of an illustrative set of elementary cells in accordance with the present invention.

FIG. 3 is a partial cross-sectional top view of an illustrative set of elementary cells. Four chambers 12*a*, 12*b*, 12*c*, 12*d* are shown, two chambers 12*a*, 12*d* on an upper level shown in solid lines, and two chambers 12*b*, 12*c* on a lower level shown in dashed lines. Two chambers 12*a*, 12*d* on an upper level may be in registration with the two chambers 12*b*, 12*c* on a lower level, or offset as shown. Three horizontal conduits 42*a*, 42*b*, 42*c* and two vertical conduits 44*a*, 44*b*, are shown as well.

The flow path for pump fluid is shown by the lines 70, 71, 72, 73, and 74. Fluid enters the pump into upper pump chamber 12*a* through horizontal conduit port 42*a*, as shown at 70. Fluid then passes from upper chamber 12*a* to lower chamber 12*b* via vertical conduit 44*a*, as shown at 71. The fluid then passes from lower chamber 12*b* into lower chamber 12*c* via horizontal conduit 42*b*, as shown at 72. Then, fluid passes from lower chamber 12*c* to upper chamber 12*d* via vertical conduit 44*b*, as shown at 73. Finally, fluid passes from the upper chamber 12*d* through horizontal conduit 42*c* out of the pump, as shown at 74.

Figure 4:
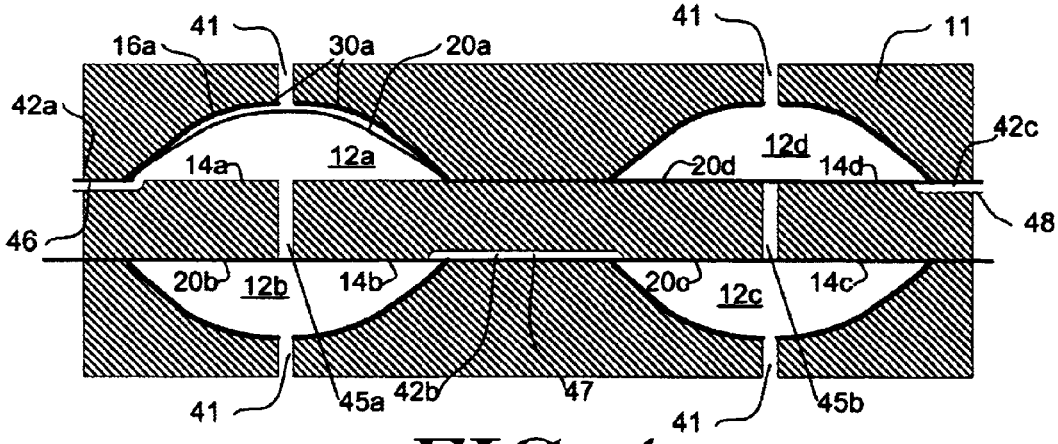
FIG. 4 is a cross-sectional side view of an illustrative set of four elementary cells in accordance with the present invention.

FIG. 4 is a cross-sectional side view of an illustrative set of four elementary cells similar to those shown in FIG. 3. The four chambers 12*a*, 12*b*, 12*c*, 12*d* are disposed within a body 11. Horizontal conduits 42*a*, 42*b*, 42*c*, outer vertical conduits 41 and inner vertical conduits 45*a* and 45*b* are also shown. In the illustrative embodiment, horizontal conduit 42*a* is an inlet port 46, horizontal conduit 42*b* is an interconnecting conduit 47, and horizontal conduit 42*c* is an outlet port 48.

First chamber 12*a* is in fluid communication with the inlet port 46 and the first inner vertical conduit 45*a*. The first inner vertical conduit 45*a* is also in fluid communication with the second chamber 12*b*. The second chamber 12*b* is in fluid communication with third chamber 12*c* through interconnecting conduit 47. The third chamber 12*c* is in fluid communication with the fourth chamber 12*d* through the second inner vertical conduit 45*b*. Finally, the fourth chamber 12*d* is in fluid communication with the outlet port 48.

A first diaphragm 20*a* is positioned in the first chamber 12*a*, a second diaphragm 20*b* is positioned in the second chamber 12*b*, a third diaphragm 20*c* is positioned in the third chamber 12*c*, and a fourth diaphragm 20*d* is positioned in the fourth chamber 12*d*. The first and fourth diaphragms 20*a* and 20*d* may be formed from a common sheet of material, if desired. Likewise, the second and third diaphragms 20*b* and 20*c* may be formed from a common sheet of material.

The first diaphragm is shown in the activated state, preferably positioned adjacent the second opposing wall 16*a* of the first chamber 12*a*. The other three diaphragms 20*b*, 20*c*, 20*d* are shown in the un-activated state, preferably conforming to first opposing walls 14*b*, 14*c*, 14*d*, of the remaining three chambers 12*b*, 12*c*, 12*d*, respectively.

Notably, no check valves are shown in FIG. 4. If so desired, check valves could be included in several locations and in various combinations. Possible locations include the inlet 46, first vertical conduit 45*a*, interconnecting conduit 47, second vertical conduit 45*b*, and outlet 48. Alternatively, it is conceived that exclusion of check valves may reduce fabrication costs and simplify the pump assembly. Further, check valves are subject to limitations at low flow rates or low pressures, while the configuration of the present invention configuration may avoid some of these limitations.

Figure 5A:
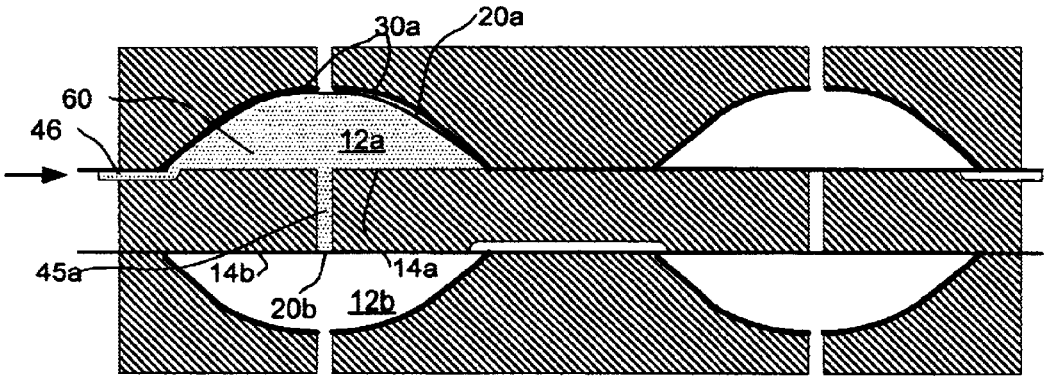
FIGS. 5A–5E show a series of cross-sectional side views of the illustrative electrostatically actuated pump of FIG. 4 in action.

FIGS. 5A–5E show a series of cross-sectional side views of the illustrative electrostatically actuated pump of FIG. 4 in action. In FIG. 5A, diaphragm 20*a* is activated to draw fluid 60 into the first chamber 12*a*. The fluid enters through inlet 46, and fills chamber 12*a*, and in some embodiments, first inner vertical conduit 45*a*. The second diaphragm 20*b* is shown deactivated, with the elastic restoring force causing the second diaphragm 20*b* to lie adjacent the first opposing wall 14*b* of the second chamber 12*b*. With the second diaphragm 20*b* adjacent the first opposing wall 14*b* of the second chamber 12*b*, the lower end of first inner vertical conduit 45*a* may be closed or substantially closed.

Figure 5B:
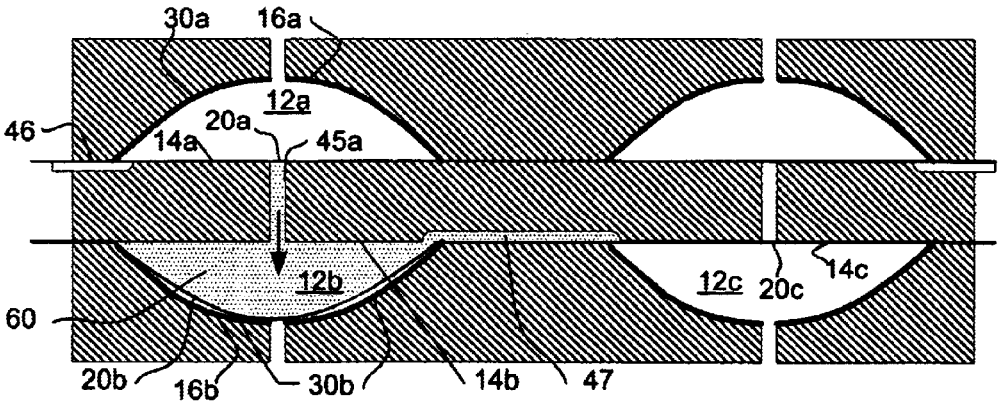

In FIG. 5B, diaphragm 20*b* is activated toward the second opposing wall 16*b* to draw fluid 60 into the second chamber 12*b* from first chamber 12*a* through the vertical conduit 45*a*. As diaphragm 20*b* is activated toward the second opposing wall 30*b*, diaphragm 20*a* is de-activated and pulled by an elastic restoring force of the first diaphragm 20*a*, and possibly suction toward the first opposing wall 14*a* of the first chamber 12*a*. In a preferred embodiment, diaphragm 20*a* preferably comes into contact with the first opposing wall 14*a* at the outer edges first. When the diaphragm 20*a* comes into contact the outer edges, the diaphragm 20*a* may close inlet 46, isolating inlet 46 from the rest of the first chamber 12*a* and cutting off potential backflow. Fluid 60 is thus forced by diaphragm 20*a* and pulled by diaphragm 20*b* through vertical conduit 45*a* into the second chamber 12*b*.

As diaphragm 20*b* pulls away from the first opposing wall 14*b*, diaphragm 20*b* opens the lower end of vertical conduit 45*a* into chamber 12*b*, but limits fluid 60 entering chamber 12*b* to only one side of the diaphragm 20*b*. As diaphragm 20*b* continues moving toward second opposing wall 16*b*, diaphragm 20*b* opens a first end of interconnecting conduit 47. Fluid 60 enters interconnecting conduit 47, but is prevented from entering third chamber 12*c* because, when third diaphragm 20*c* is adjacent the first opposing wall 14*c*, third diaphragm 20*c* may close or substantially close the second end of interconnecting conduit 47. Diaphragm 20*a* eventually may reach a point where it is adjacent the first opposing wall 14*a*, at which time diaphragm 20*a* closes the upper end of vertical conduit 45*a* and prevents or substantially prevents fluid 60 from flowing back through vertical conduit 45*a* into the first chamber 12*a*.

Figure 5C:
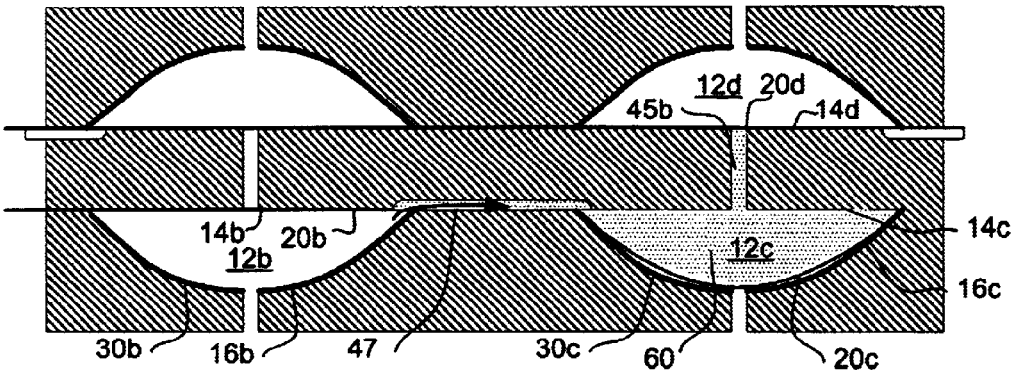

In FIG. 5C, fluid 60 moves through interconnecting conduit 47 from second chamber 12*b* to third chamber 12*c*. The fluid 60 is pushed as the second diaphragm 20*b* is de-activated and moves from second opposing wall 16*b* toward the first opposing wall 14*b*. Because (as detailed in FIG. 5B) the first diaphragm 20*a* is adjacent first opposing wall 14*a*, vertical conduit 45*a* is closed at the upper end, so fluid 60 is substantially prevented from flowing into first chamber 12*a*, and instead flows into third chamber 12*c*.

As second diaphragm 20*b* moves towards the first opposing wall 14*b*, third diaphragm 20*c* is activated and moves towards the second opposing wall 16*c*, pulling fluid 60 into the third chamber 12*c*. The second end of interconnecting conduit 47 is opened as third diaphragm 20*c* pulls away from first opposing wall 14*c*. The diaphragms 20*b* and 20*c* move, possibly in unison though perhaps in succession, until the second diaphragm 20*b* assumes a position adjacent the first opposing wall 14*b*, thereby closing the first end of interconnecting conduit 47, and the third diaphragm 20*c* assumes a position adjacent second opposing wall 16*c*.

The fourth diaphragm 20*d* is in a position adjacent the first opposing wall 14*d*. With fourth diaphragm 20*d* adjacent the first opposing wall 14*d*, the second vertical conduit 45*b* remains closed at the upper end. The lower end of vertical conduit 45*b* is opened when third diaphragm 20*c* moves away from first opposing wall 14*c*.

Figure 5D:
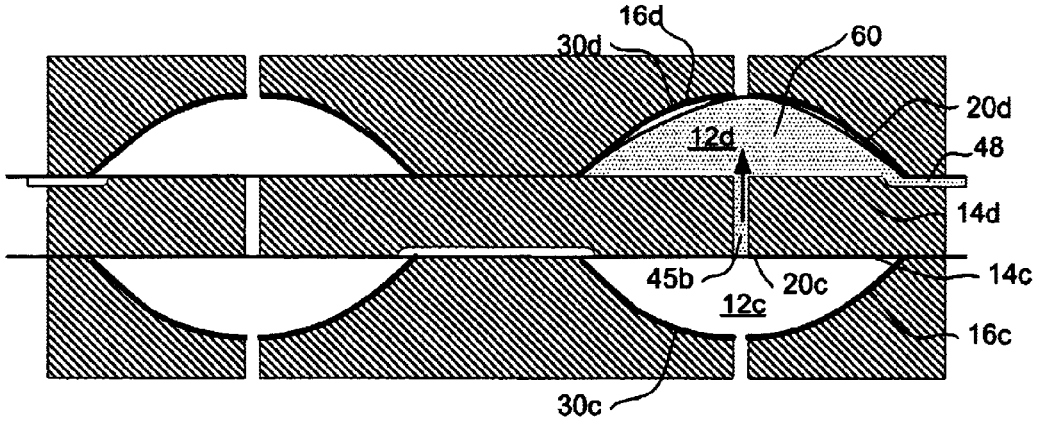

In FIG. 5D, fluid 60 is moved from the third chamber 12*c* to the fourth chamber 12*d* through the vertical conduit 45*b*. Diaphragms 20*c* and 20*d* have both been moved. Diaphragm 20*c* has been moved, preferably by elastic restoring forces, from the second opposing wall 16*c* towards the first opposing wall 14*c*, pushing fluid 60 through vertical conduit 45*b* while blocking the second end of interconnecting conduit 47. Meanwhile, the second end of interconnecting conduit 47 is also blocked by diaphragm 20*b*, which remains adjacent first opposing wall 14*b*.

Fourth diaphragm 20*d* is moved from the first opposing wall 14*d* to a position adjacent second opposing wall 16*d*, pulling fluid 60 into the fourth chamber 12*d*. Eventually, third diaphragm 20*c* assumes a position adjacent the first opposing wall 14*c*, blocking the lower end of vertical conduit 45*b*. Meanwhile, fourth diaphragm 20*d* assumes a position adjacent the second opposing wall 14*d*, opening the outlet 48.

Figure 5E:
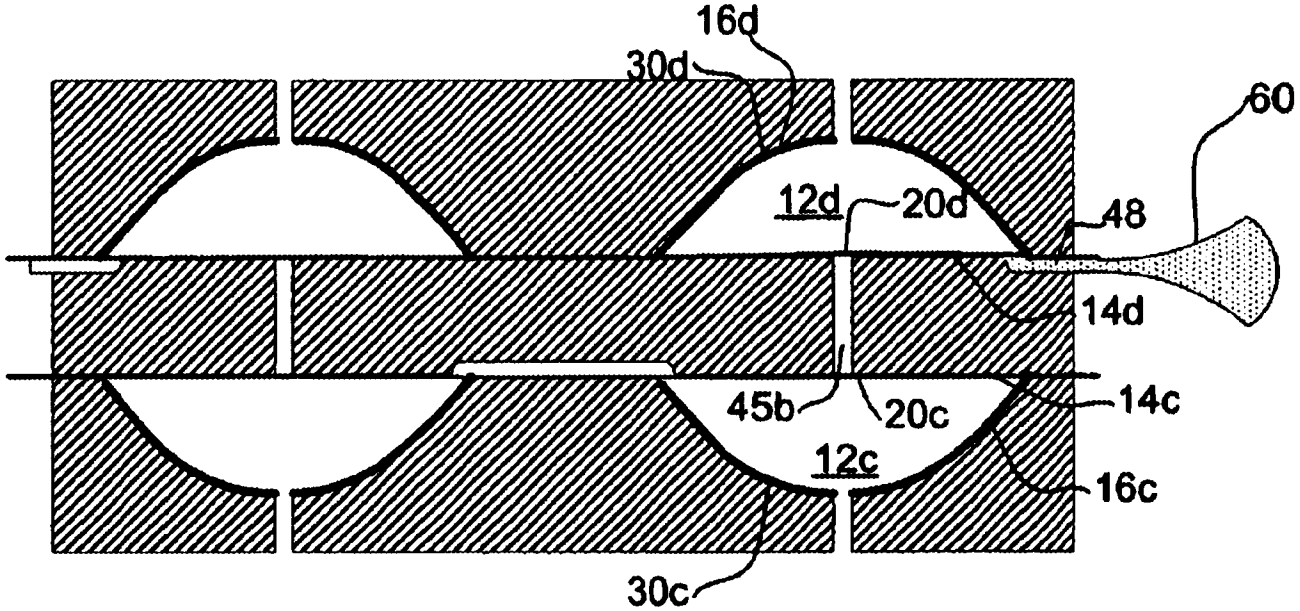

Finally, and as shown in FIG. 5E, fluid 60 is expelled from the fourth chamber 12*d* through outlet 48. Fluid is expelled as fourth diaphragm 20*d* moves, preferably by elastic restoring forces, from the second opposing wall 16*d* towards the first opposing wall 14*d*, while third diaphragm 20*c* holds the lower end of vertical conduit 44*b* closed, thereby preventing backflow of fluid 60. Fluid 60 continues to be expelled until diaphragm 20*d* reaches a position where it closes outlet 48. Diaphragm 20*d* preferably closes outlet 48 just as the diaphragm 20*d* reaches a position adjacent or nearly adjacent to the first opposing wall 14*d*.

As noted above, the diaphragms 20*a*, 20*b*, 20*c*, 20*d* may be moved as a result of forces generated in various ways. Preferably, motion towards the second opposing walls 16*a*–16*d* is effected by applying a voltage differential between selected stationary electrodes 30*a*–30*d* on the second opposing walls 16*a*–16*d* and electrodes disposed on diaphragms 20*a*–20*d* (shown by bold lines). In this configuration, fluid 60 does not pass between any of the stationary electrodes 30*a*–30*d* and those electrodes disposed on diaphragms 20*a*–20*d*. Thus, the various properties of the fluid 60 may not interfere with the electrostatic actuation of the diaphragms 20*a*–20*d*. Alternatively, motion toward first opposing walls 14*a*–14*d* from the second opposing walls 16*a*–16*d* may be effected by applying voltage of the same polarity to selected stationary electrodes 30*a*–30*d* and the electrodes on the diaphragms 20*a*–20*d*.

Motion opposite of that effected by application of electrostatic forces may be augmented or effected by use of diaphragms 20*a*–*d* made of materials having shape memory characteristics, or by diaphragms having elastic properties where the diaphragms are disposed in the chambers 12*a*–12*d* under tension, or combinations of both. Motion in either direction may be augmented or effected by back pressure or suction applied through outer vertical conduits 40 (shown in FIG. 4).

Further, though the drawings show inlets, outlets, interconnecting conduits and vertical conduits in fluid communication with only certain areas of each chamber, it is not necessary for this to be the case. In some embodiments, for example, outlet 48 may be in fluid communication with fourth chamber 12*d* at a location near the center of fourth chamber 12*d*, to better enable diaphragm 20*d* to keep the opening between the outlet 48 and the chamber 12*d* open until a substantial portion of fluid 60 is expelled. In another illustrative embodiment, the diaphragms 20*a*, 20*b*, 20*c*, 20*d* are designed to moved under restoring forces such that their outer portions contact first opposing walls 14*a*, 14*b*, 14*c* and

14*d* before their center portions do. In such a case, it may be advantageous, for example, to position the chambers and conduits such that, for example, first vertical conduit 45*a* enters second chamber 12*b* at a location near the edge of the chamber to ensure early closure of first vertical conduit 45*a*, reducing potential backflow. Other configurations involving other cells and conduits are also contemplated. Two illustrative configurations of this nature are included in FIGS. 14A and 14B.

In several embodiments of the present invention, it is conceived that check valves can be omitted, simplifying the process of fabrication and reducing costs. Check valves may be omitted in several embodiments because, as shown in FIGS. 5A–5E, the diaphragms 20*a*, 20*b*, 20*c*, 20*d* may cut off fluid communication in each of several locations. Thus, the diaphragms 20*a*, 20*b*, 20*c*, 20*d* may be used in the place of check valves in some embodiments.

In several other embodiments of the present invention, the timing sequence of diaphragm activations may be manipulated to control flow rate. Particularly, in some embodiments, the pump may be used to effect an efficient low-flow-rate or low-pressure pumping action by performing the pumping steps shown in FIGS. 5A and 5B relatively quickly, for example, and then performing the pumping steps shown in FIGS. 5C–5E in more slowly. One way of performing the pumping steps more slowly may be to hold a pumping fluid in a particular chamber for an extended period of time. Because successive diaphragms are used to hold the pumping fluid in a particular chamber, rather than check valves, a given chamber (particularly the second chamber 12*b* and third chamber 12*c*) may hold the pumping fluid for some period of time. Another way to slow the pumping rate may be to utilize a ramp function for transitions for each diaphragm from an activated to an un-activated state, instead of the step functions shown in FIGS. 6A–6B. Such a ramp function could be a linear and gradual function, but other functions such as a parabolic curve, could also be implemented. In some embodiments, incorporation of a gradual curve into the signal controlling deflection of the diaphragms may enable a more steady output flow to be achieved, even at low pressures and flow rates.

Figure 6A:
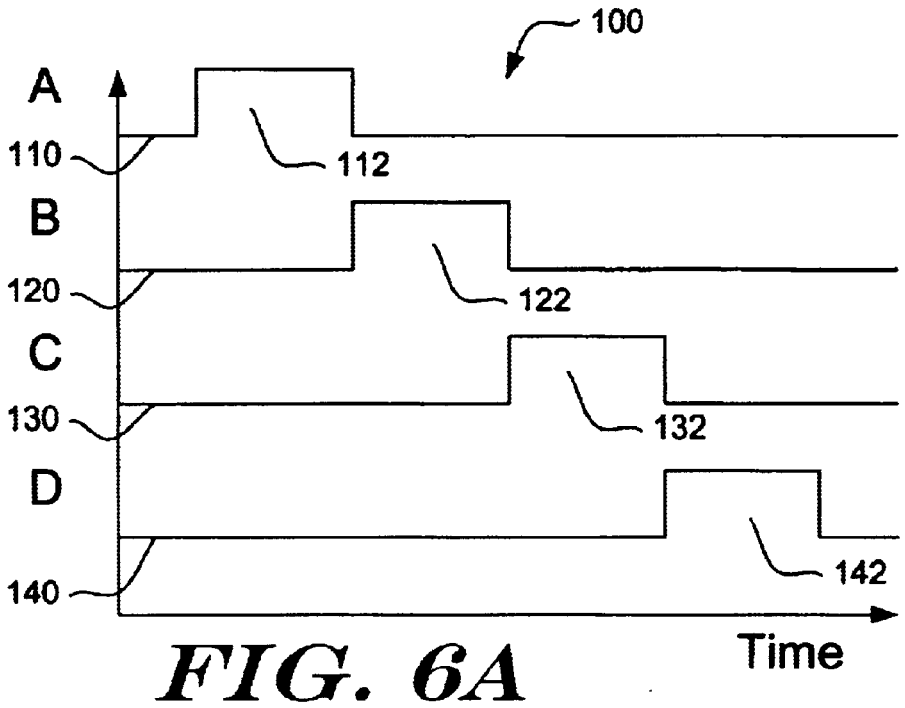
FIGS. 6A–6B are timing diagrams showing illustrative activation sequences for the illustrative electrostatically actuated pump of FIGS. 5A–5E.
Figure 6B:
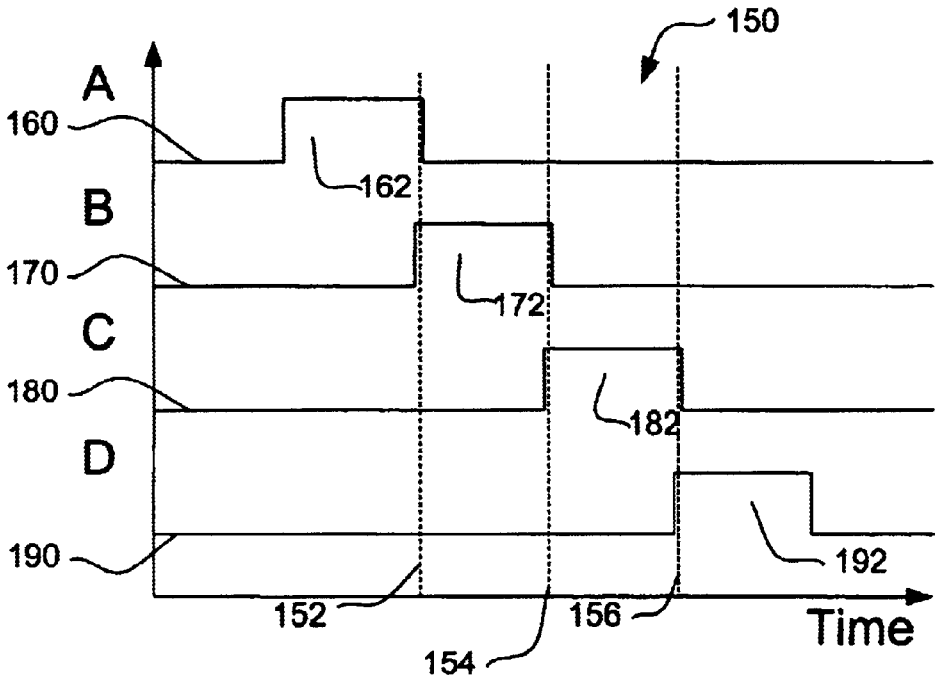

FIGS. 6A–6B are timing diagrams showing illustrative activation sequences for the illustrative electrostatically actuated pump of FIGS. 5A–5E. FIG. 6A is a timing diagram 100 with four signals 110, 120, 130, 140 shown. Each signal 110, 120, 130, 140 has a single pulse 112, 122, 132, 142, respectively, where the signal is "HIGH," and remains low during the remainder of the time. Signal 110 corresponds to the voltage applied between the stationary electrode 30*a* and the electrode on the diaphragm 20*a* of the first chamber 12*a*. Signal 120 corresponds to the voltage applied between the stationary electrode 30*b* and the electrode on the diaphragm 20*b* of the second chamber 12*b*. Signal 130 corresponds to the voltage applied between the stationary electrode 30*c* and the electrode on the diaphragm 20*c* of the third chamber 12*c*. Signal 140 corresponds to the voltage applied between the stationary electrode 30*d* and the electrode on the diaphragm 20*d* of the fourth chamber 12*a*.

In the illustrative embodiment, signal 110 goes high first, as shown by pulse 112. This corresponds to the configuration shown in FIG. 5A, which shows the diaphragm 20*a* pulled towards the second opposing wall 16*a* by an electrostatic force. Next, signal 120 goes high, as shown by pulse 122. This corresponds to the configuration shown in FIG. 5B, which shows the diaphragm 20*b* pulled towards the second opposing wall 16*b* by an electrostatic force. The diaphragm 20*a* is released when pulse 112 ends, and is pulled back toward the first opposing wall under an elastic force. Next, signal 130 goes high, as shown by pulse 132. This corresponds to the configuration shown in FIG. 5C, which shows the diaphragm 20*c* pulled towards the second opposing wall 16*c* by an electrostatic force. The diaphragm 20*b* is released when pulse 122 ends, and is pulled back toward the first opposing wall under an elastic force. Finally, signal 140 goes high, as shown by pulse 142. This corresponds to the configuration shown in FIG. 5D, which shows the diaphragm 20*d* pulled towards the second opposing wall 16*d* by an electrostatic force. The diaphragm 20*c* is released when pulse 132 ends, and is pulled back toward the first opposing wall under an elastic force.

FIG. 6B is another timing diagram 150 with the various signal pulses 162, 172, 182, 192 overlapping one another. In the illustrative embodiment, signal pulse 162 occurs first, and is followed by signal pulse 172. Signal pulse 172 goes "HIGH", however, prior to time 152, while pulse 162 does not go low until after time 152. The diagram 150 suggests simultaneous movements of the diaphragms in a given pump. Such simultaneous movement may be used to offset the fact that it takes a certain amount of time for the diaphragms to move from one position to another, or may be used to shape the way the diaphragms change positions.

Figure 6C:
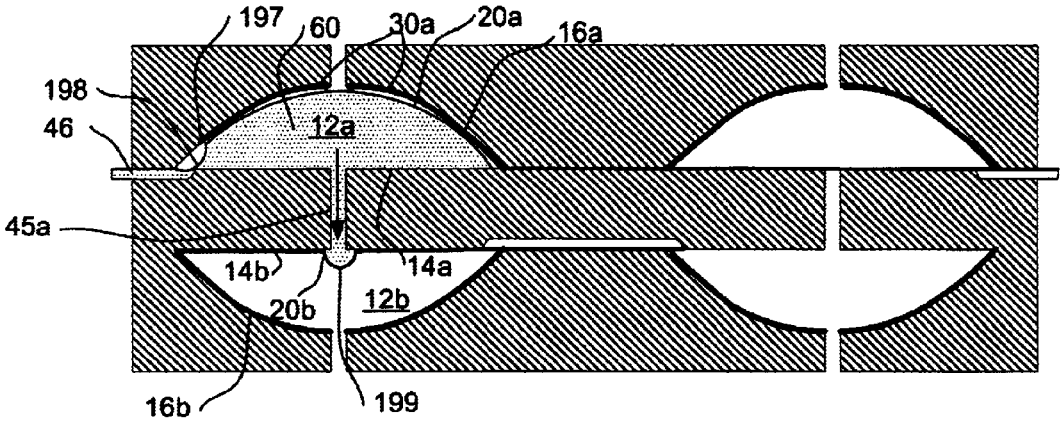
FIG. 6C shows an illustrative pump at a time corresponding to time 152 in FIG. 6B.

For example, and referring to FIG. 6C, electrode 30*a* may not cover the entire second opposing wall 16*a*, having an end 197. The inlet 46 may corresponds to an area of the second opposing wall 16*a* where the electrode 30*a* does not extend. FIG. 6C illustrates the pump at a time corresponding to time 152 in FIG. 6B. The second diaphragm 20*b* is pulled toward the second opposing wall 16*b* before the first diaphragm 20*a* is released. As the electrostatic pulling force is applied to the second diaphragm 20*b*, the section 198 of the first diaphragm 20*a* may be pulled down to block off inlet 46, which may help prevent backflow from the first chamber 12*a*. Also, the second diaphragm 20*b* can only deform a slight amount under these conditions, as shown at 199. Once pulse 162 terminates, the first diaphragm 20*a* preferably returns to a position adjacent the first opposing wall 14*a*.

Figure 7:
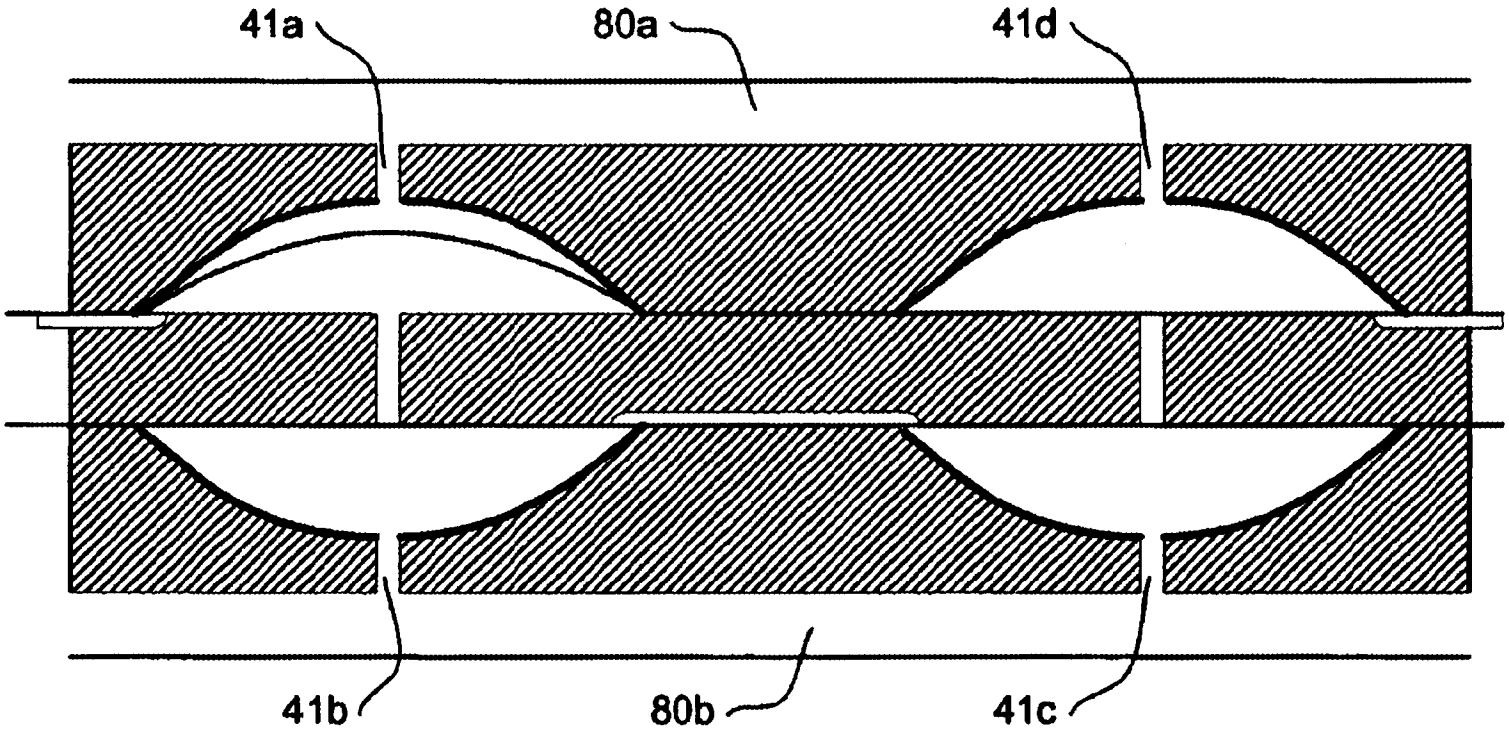
FIG. 7 is a cross-sectional side view of a set of elementary cells including back-pressure channels.

FIG. 7 is a cross-sectional side view of a set of elementary cells with back pressure channels. Each chamber has an outer vertical conduit, such as outer vertical conduits 41*a*–41*d*. The outer vertical conduits 41*a*–41*d* are in fluid communication with one or more back pressure channels, such as back pressure channels 80*a* and 80*b*. In the embodiment shown, back pressure channels 80*a* and 80*b* may be passive and provide pressure relief as the corresponding diaphragms are activated. However, in some embodiments, the back pressure channels 80*a* and 80*b* may be active, providing positive and/or negative pressure behind the diaphragms to aid in pumping, if desired. When active, the pressure applied may be adjusted during operation to, for example, compensate for different modes of operation, compensate for changes in atmospheric pressure, etc.

Figure 8:
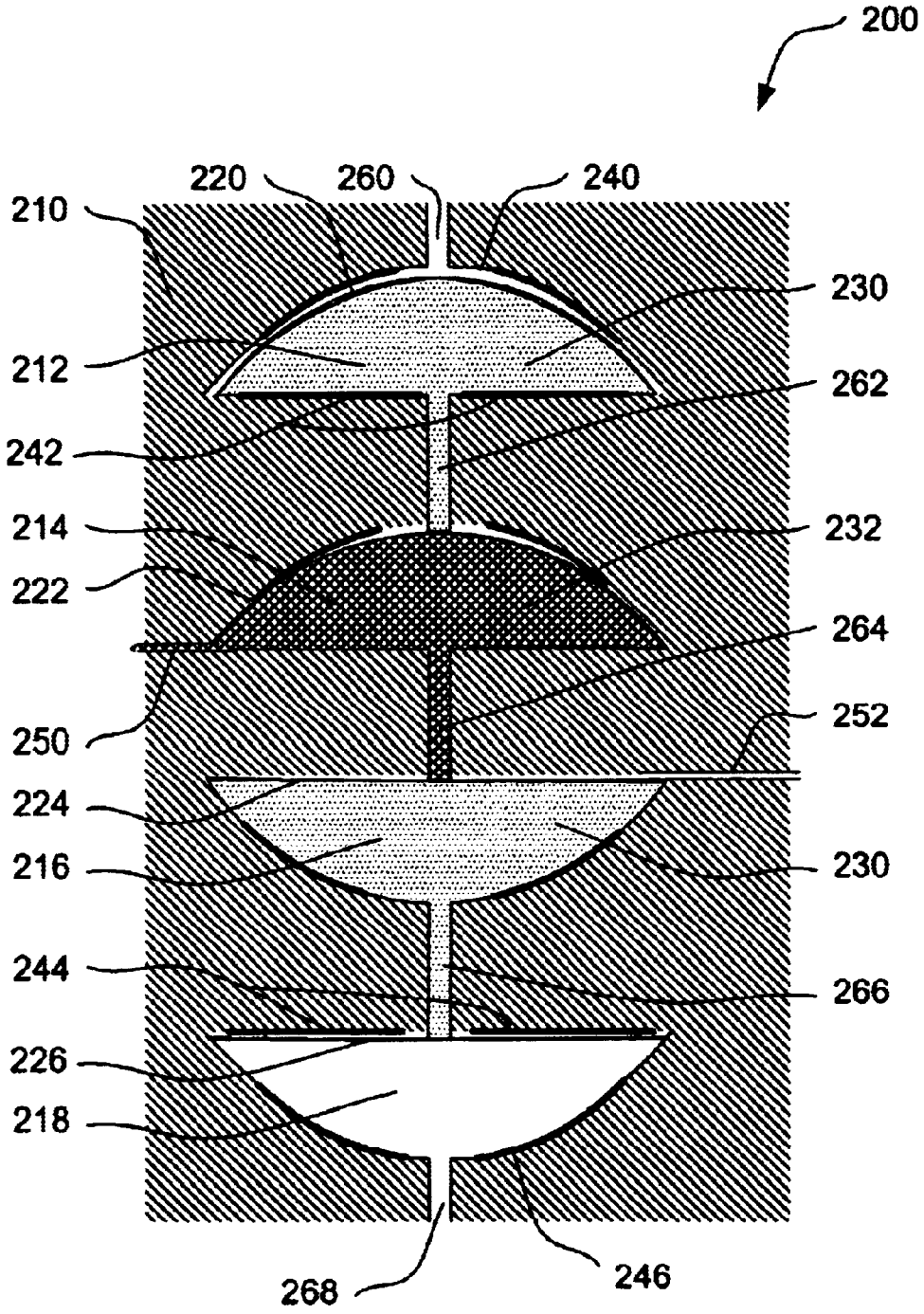
FIG. 8 is a cross-sectional side view of an illustrative pump with active back-pressure control.

FIG. 8 is a cross-sectional side view of an illustrative pump 200 with active back pressure devices. The pump 200 includes a body 210. Body 210 has four chambers 212, 214, 216, 218. Chamber 212 has diaphragm 220, chamber 214 has diaphragm 222, chamber 216 has diaphragm 224, and chamber 218 has diaphragm 226. The innermost chambers 214 and 216 are the pumping chambers, while the outermost chambers 212 and 218 are backpressure assist chambers. Chamber 214 includes an inlet port 250 that allows fluid to flow into chamber 214, preferably on the lower side of diaphragm 222. Chamber 216 is in fluid communication with chamber 214 through intermediate conduit 264, and has an outlet port 252. Diaphragm 222 and 224 are preferably moved in a manner as described above to move fluid from the inlet port 250, through the intermediate conduit 264, and out the outlet port 252.

To move or assist in moving the diaphragm 222 and 224, back pressure chambers 212 and 218 may be provided. Back pressure chamber 212 has a diaphragm 220 that can be electrostatically moved from an upper position to a lower position, and/or from a lower position to an upper position. Likewise, back pressure chamber 218 has a diaphragm 226 that can be electrostatically moved from a lower position to an upper position, and/or from an upper position to a lower position. Outer back pressure conduits 260 and 268 provide pressure relief to the back pressure chambers 212 and 218. Inner back pressure/suction conduits 262 and 266 provide pressure and/or suction to the innermost chambers 214 and 216, as further described below.

A back pressure fluid 230 is shown disposed in two of the chambers 212 and 216. The back pressure fluid 230 is provided on the opposite side of the diaphragms 222 and 224 than the fluid. The back pressure fluid 230 preferably remains in the pump 200. The back pressure fluid 230 is preferably chosen to have particular, consistent viscous, electric, polar, conductive and/or dielectric properties. Preferably, the back pressure fluid 230 is substantially non-conductive and non-polar, maintaining consistent viscous properties across a wide range of pressures and temperatures. Further, the back pressure fluid 230 is preferably chosen to be non-corrosive with respect to the body 210, electrodes 242 and 244, and diaphragms 220, 222, 224, 226.

The back pressure chambers 212 and 226 may have one or more of the electrodes 240, 242, 244, 246, as shown. Electrode 242 may be used to draw the diaphragm 220 in a downward direction, and electrode 240 may be used to draw the diaphragm 220 in an upward direction, as desired. Likewise, electrode 244 may be used to draw the diaphragm 226 in an upward direction, and electrode 246 may be used to draw the diaphragm 226 in a downward direction, as desired. Diaphragms 220 and 226 may be classified as "back pressure" diaphragms, and each preferably includes an electrode. Diaphragms 222 and 224 may be classified as "pump" diaphragms, which may or may not include electrodes. If no electrodes are provided on the pump diaphragms 222 and 224, diaphragms 222 and 224 may be moved solely by pressure and suction applied by the movement of back pressure diaphragms 220 and 226. The back pressure diaphragms 220 and 226 are preferably moved by electrostatic and/or elastic forces, as described above. If electrodes are provided on the pump diaphragms 222 and 224, back pressure diaphragms 220 and 226 may provide additional force, as needed. The back pressure diaphragms 220 and 226 may also provide a back-up or failsafe pumping mechanism for sensitive pumping systems.

Figure 9:
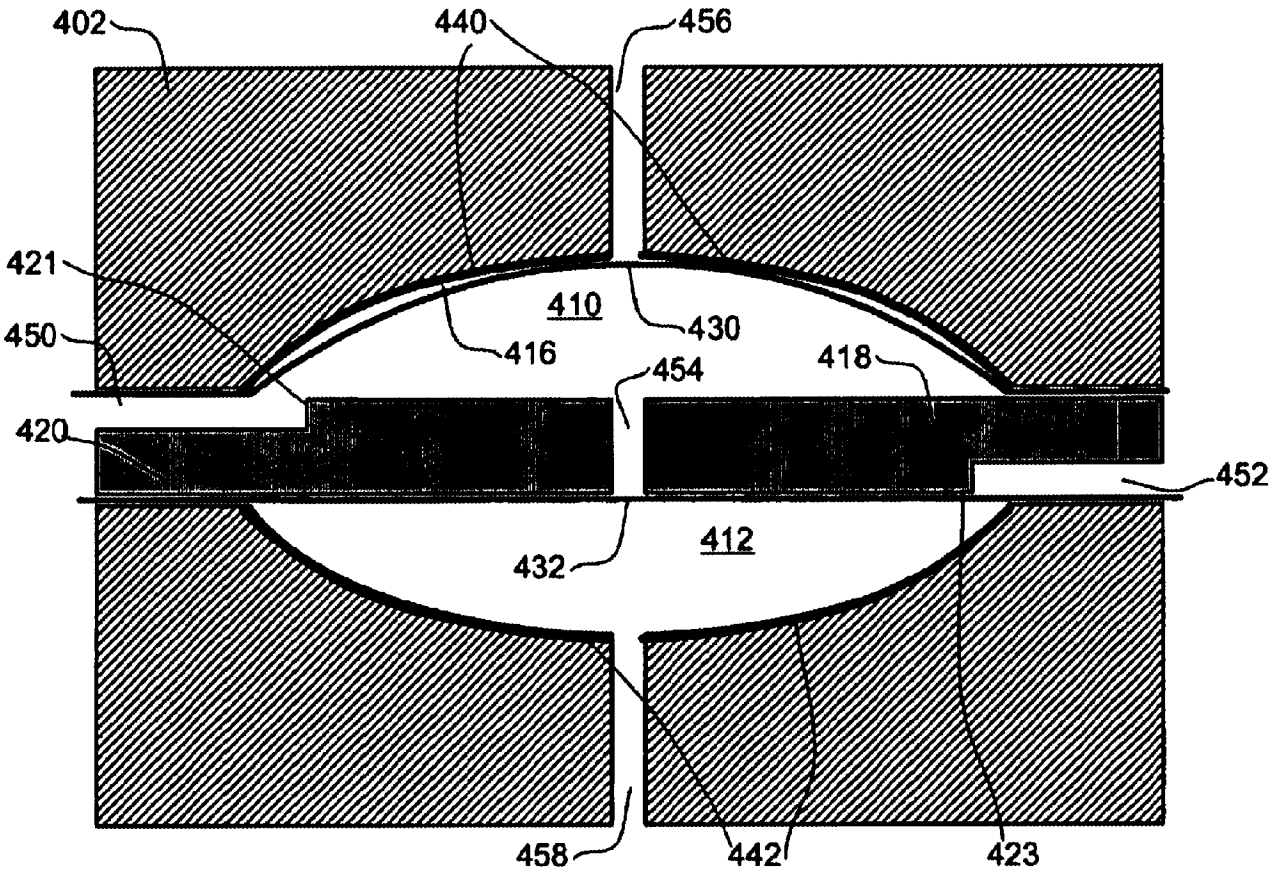
FIG. 9 is a cross-sectional side view of an illustrative pump having self-closing inlet and outlet ports.

FIG. 9 is a cross-sectional side view of another illustrative pump embodiment. The pump may include a first chamber 410 and a second chamber 412 separated by a separating wall 420. A first or upper diaphragm 430 is disposed in the first chamber 410 and a second or lower diaphragm 432 is disposed in the second chamber 412. The first chamber 410 has an upper opposing wall 416 and a lower opposing wall 418. Electrode 440 is disposed on the upper opposing wall 416. One or more electrodes (not numbered) are disposed on, adjacent to, or incorporated within diaphragm 430. Likewise, the second chamber 412 has an upper opposing wall and a lower opposing wall. Electrode 442 is disposed on the lower opposing wall. One or more electrodes (not numbered) are disposed on, adjacent to, or incorporated within diaphragm 432.

Inlet port 450 is in fluid communication with the first chamber 410, and outlet port 452 is in fluid communication with the second chamber 412. The first chamber 410 is in fluid communication with the second chamber 412 through a vertical conduit 454 through the separating wall 420. Vertical conduits 456 and 458 are disposed in the body 402, as shown.

In the illustrative embodiment, the lower opposing wall 418 of the upper chamber 410 may include a notch 421 near the inlet port 450. The notch 421 may increase the size of the inlet port 450 when the diaphragm 430 is moved toward the upper opposing wall 416. The notch 421 may also help close the inlet port 450 when the upper diaphragm 430 moves toward the lower opposing wall 418. Likewise, the upper opposing wall of the second chamber 412 may have a notch 423, which may increase the size of the outlet port 452 when the diaphragm 432 moves toward the lower opposing wall of the second chamber 412. Notch 423 may also help close the outlet port 452 when the lower diaphragm 432 moves toward the upper opposing wall of the second chamber 412.

Figure 10A:
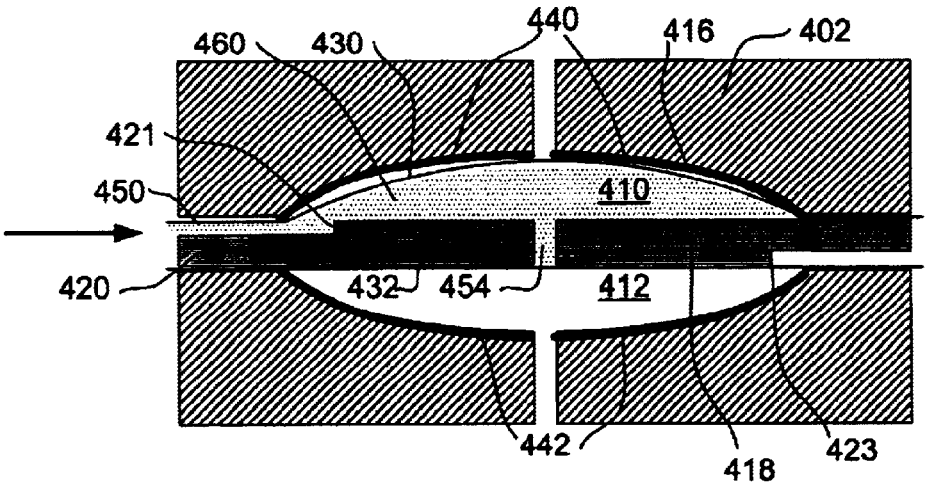
FIGS. 10A–10C show a series of cross-sectional side views of the illustrative pump of FIG. 9 in action.
Figure 10B:
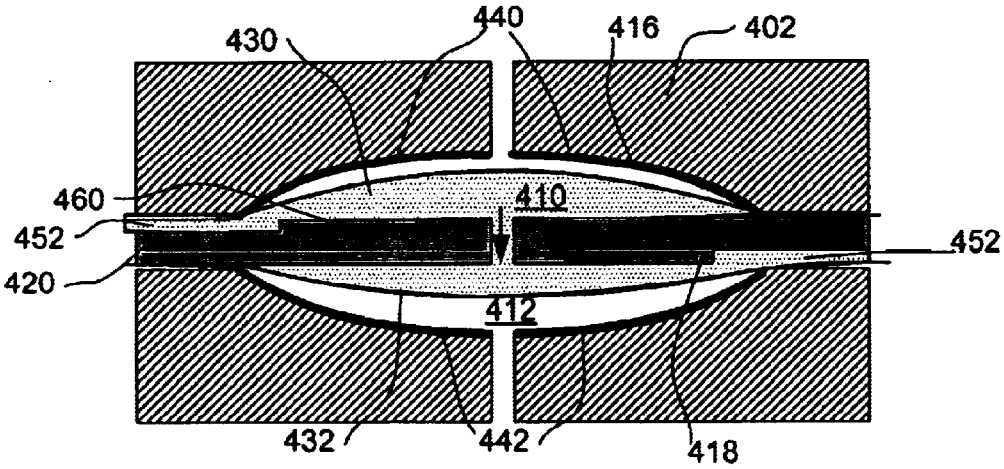
Figure 10C:
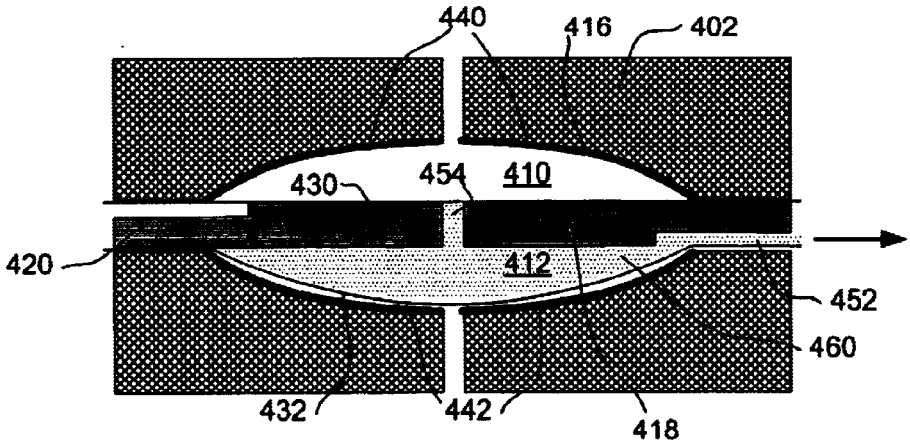

FIGS. 10A–10C shown a series of cross-sectional side views of the illustrative pump of FIG. 9 in action. In FIG. 10A, the first chamber 410 is filled with fluid 460 as a result of the upper diaphragm 430 having moved to become adjacent the upper opposing wall 416, thereby pulling fluid 460 into first chamber 410 through inlet 450. Meanwhile, the lower diaphragm 432 is positioned adjacent the separating wall 420, closing off the lower opening of vertical conduit 454.

In FIG. 10B, the upper diaphragm 430 and lower diaphragm 432 are both moving in a downward direction, thereby pushing fluid 460 from the first chamber 410 to the second chamber 412 through the vertical conduit 454. As this motion takes place, the inlet port 450 is cut off from the first chamber 410 by the motion of the upper diaphragm 430. Notch 421 may help cut off the inlet port 450, as shown. Meanwhile, the movement of the lower diaphragm 432 opens the outlet port 452.

In FIG. 10C, the upper diaphragm 430 is adjacent the lower opposing wall 418 of the first chamber 410, effectively cutting off fluid communication between the first chamber 410 and the upper end of the vertical conduit 454. The lower diaphragm 432 is shown adjacent the lower wall of the second chamber 412, with the outlet port 452 open. Notch 423 may increase the size, and thus the flow, of the outlet port 452. As the lower diaphragm 432 returns to a position adjacent the lower side of the separating wall 420, fluid 460 is forced through the outlet port 452, resulting in a pumping action. Notch 423 may help cut off the outlet port 452 as the lower diaphragm 432 returns to a position adjacent the lower side of the separating wall 420.

Figure 11:
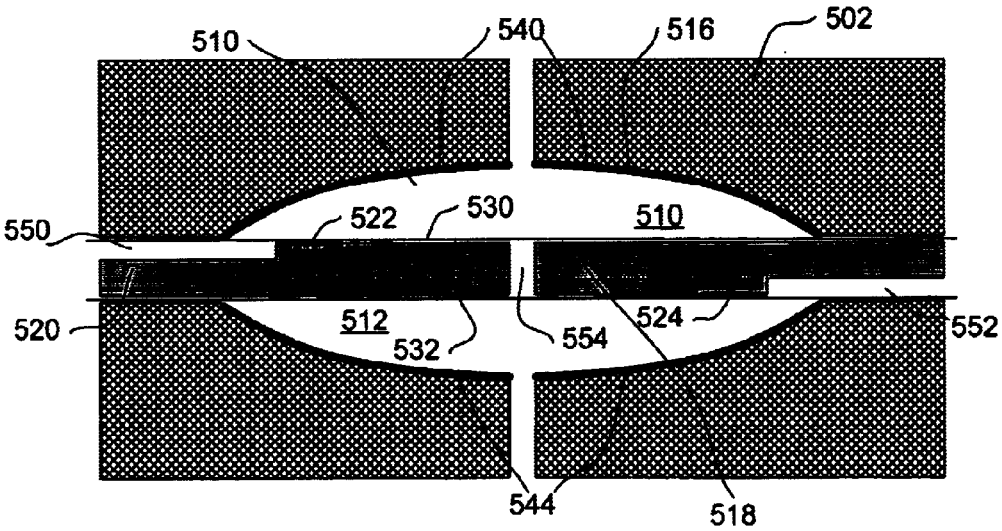
FIG. 11 is a cross-sectional side view of an illustrative pump that has supplemental electrodes to help close the inlet and outlet ports.

FIG. 11 is a cross-sectional side view of an illustrative pump with additional electrodes incorporated into the cell. The illustrative embodiment is similar to that shown in FIGS. 10A–10C, but includes additional electrodes 522 and 524, disposed on the inner wall 520. Electrodes 522 and 524 can be used to assist in cutting off the inlet port 550 and the outlet 554, as needed, in conjunction with one or more electrodes disposed on the diaphragms 530 and 532. Although these electrodes may be subject to variations in effectiveness due to the properties and makeup of the fluid being pumped, the electrodes 522 and 524 can be used to assist in pulling a small part of the diaphragms 530 and 532 to a single location. The single location is preferably chosen to cut off the inlet port 550 and/or the outlet 554, early in each pumping cycle, to help reduce backflow in the pump.

Figure 12:
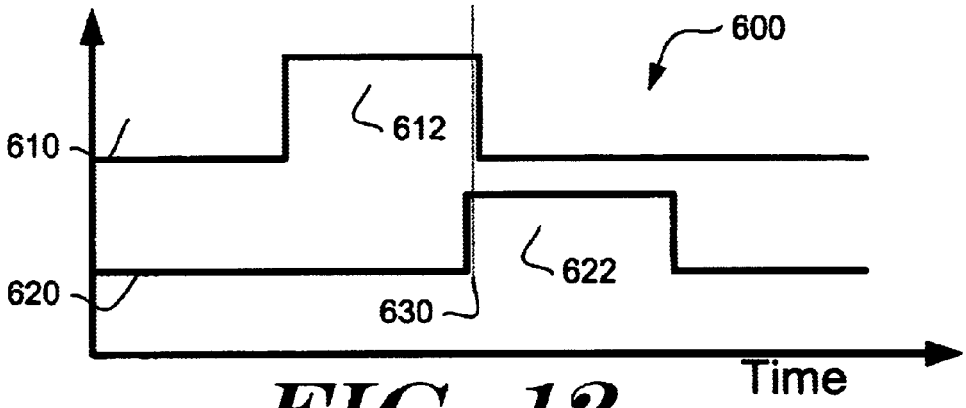
FIG. 12 is a timing diagram showing an illustrative activation sequence for the illustrative pump of FIG. 9.

FIG. 12 is a timing diagram 600 showing an illustrative activation sequence for the illustrative pump shown in FIGS. 10A–10C. A first signal is shown at 610, and includes a first pulse 612. The first signal 610 represents an illustrative activation voltage versus time between the upper electrode 440 on the upper opposing wall 416 of the first chamber 410 and one or more electrodes on, adjacent to, or incorporated in diaphragm 430 (see FIG. 10A). A second signal is shown at 620, and includes a first pulse 622. The second signal 620 represents an illustrative activation voltage versus time between the electrode 442 on the lower opposing wall of the second chamber 412 and one or more electrodes on, adjacent to, or incorporated in diaphragm 432 (see FIG. 10A).

It is contemplated that pulse 612 may or may not overlap pulse 622. In the illustrative embodiment, pulse 612 is shown overlapping pulse 622 at time 630. Overlapping pulse 612 with 622 may be helpful in, for example, reducing the backflow of the pump out of the inlet 450, allowing the second chamber 412 to become completely filled, etc. Because pulse 612 overlaps pulse 622, diaphragm 432 may begin moving before diaphragm 430 is released. This may allow diaphragm 432 to draw fluid from the first chamber 410 into the second chamber 412 through conduit 454 before diaphragm 430 is released. When pulse 612 ends, diaphragm 430 begins to move toward the lower opposing wall 418 of the upper chamber 410. At the same time, pulse 622 causes diaphragm 432 to continue to move toward electrodes 442. This action moves the fluid from the first chamber 410 to the second chamber 412, as shown in FIGS. 10A–10C.

In some embodiments, if pulse 612 does not overlap pulse 622, diaphragm 430 may push some fluid in the first chamber 410 out the inlet port 450 before the inlet port is closed, resulting in some backflow. In addition, if the first chamber 410 has the same volume as the second chamber 412, such backflow can prevent the diaphragm 432 from completely reaching the lower opposing surface of the second chamber 412 without having some backflow into the second chamber through outlet port 452. Therefore, in some embodiments, a slight overlap between pulses 612 and 622 may be desirable.

Figure 13:
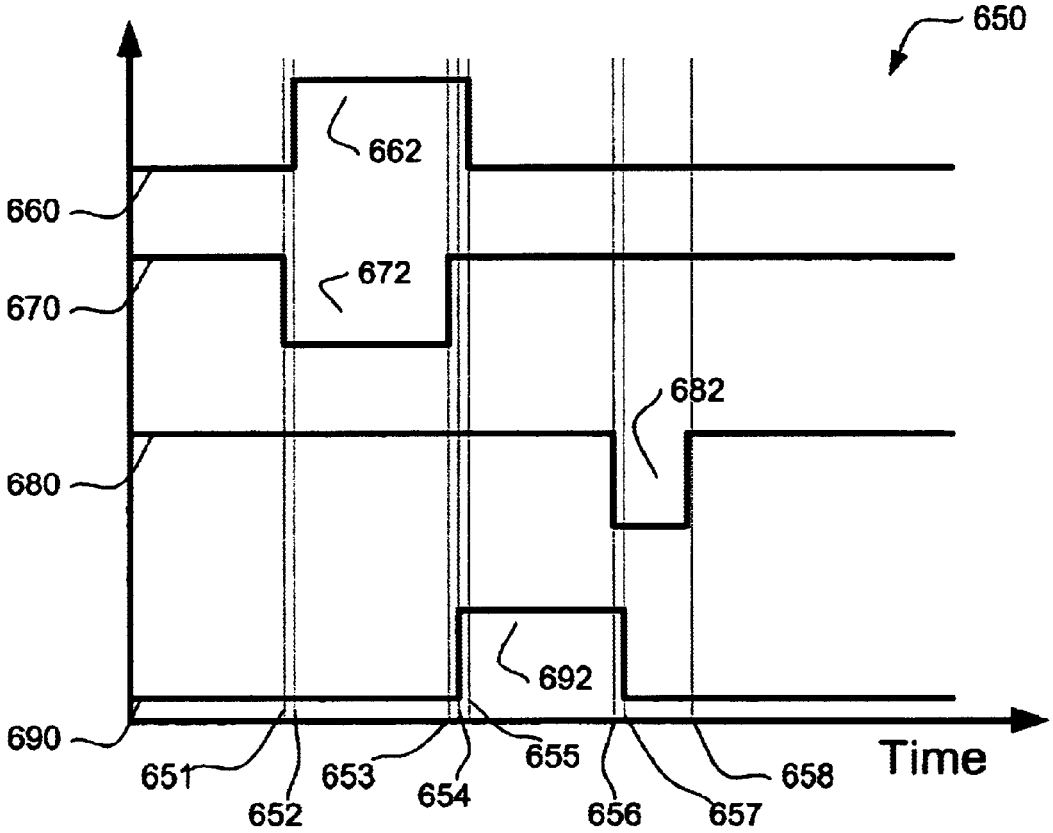
FIG. 13 is a timing diagram showing an illustrative activation sequence for the illustrative pump of FIG. 11.

FIG. 13 is a timing diagram showing an illustrative activation sequence for the illustrative pump shown in FIG. 11. Four signals are shown at 660, 670, 680, 690, each having a corresponding pulse 662, 672, 682, 692, respectively. Signal 660 represents an illustrative activation voltage versus time between the upper electrode 540 on the upper opposing wall 516 of the first chamber 510 and one or more electrodes on, adjacent to, or incorporated in diaphragm 530 (see FIG. 11). Signal 660 has a first pulse 662. Signal 690 represents an illustrative activation voltage versus time between the electrode 542 on the lower opposing wall of the second chamber 512 and one or more electrodes on, adjacent to, or incorporated in diaphragm 532 (see FIG. 11). Signal 690 includes a second pulse 692 that may overlap pulse 662, if desired.

Signal 670 represents an illustrative activation voltage versus time between electrode 522 and one or more electrodes on, adjacent to, or incorporated in diaphragm 530 (see FIG. 11). The voltage represented by signal 670 preferably results in an electrostatic attraction force between electrode 522 and diaphragm 530. Finally, signal 680 represents an illustrative activation voltage versus time between electrode 524 and one or more electrodes on, adjacent to, or incorporated in diaphragm 532 (see FIG. 11). The voltage represented by signal 680 preferably results in an electrostatic attraction force between electrode 520 and diaphragm 532.

At time 651, signal 670 goes low, indicating a release of inlet 550, enabling the inlet 550 to be opened by actuation of the upper diaphragm 530 toward upper opposing wall 516. At time 652, signal 660 goes high, pulling the upper diaphragm 530 toward upper opposing wall 516. Fluid then flows through the inlet 550 into the upper chamber 512. At time 653, signal 670 goes high, which pulls the adjacent portion of the diaphragm 530 towards electrode 522, which closes inlet 550. At time 654, signal 690 goes high, which begins to pull the lower diaphragm 632 toward the lower opposing wall of the second chamber 512. As detailed above, this may allow diaphragm 532 to draw fluid from the first chamber 510 into the second chamber 512 through conduit 554 before diaphragm 530 is released. Meanwhile, backflow is reduced because the upper diaphragm 530 is pulled toward to inner wall 520 at the location of electrode 522.

At time 655, signal 660 goes low, indicating the release of the upper diaphragm 530. Once the upper diaphragm 530 is released, diaphragm 530 begins to move toward the lower opposing wall 518 of the upper chamber 510, and lower diaphragm 532 continues to move toward the lower opposing wall of the lower chamber 512. This action moves the fluid from the first chamber 510 to the second chamber 512.

During this time, signal 680 remains high, which helps keep the lower diaphragm 532 restrained against the upper opposing wall of the lower chamber 532 in the region near electrode 524, thereby reducing inflow or outflow through outlet 552. At time 656, signal 682 goes low, which enables the outlet 552 to open as the lower diaphragm 532 is released from the point where electrode 524 is disposed on inner wall 520. At time 657, signal 690 goes low, releasing the lower diaphragm 532. Lower diaphragm begins pushing fluid out of the outlet 554, as upper diaphragm 530 is held adjacent to inner wall 520 to help prevent backflow through vertical conduit 552. At time 658, signal 680 goes high, pulling the lower diaphragm 532 toward electrode 524 to again close off outlet 552.

Figure 14A:
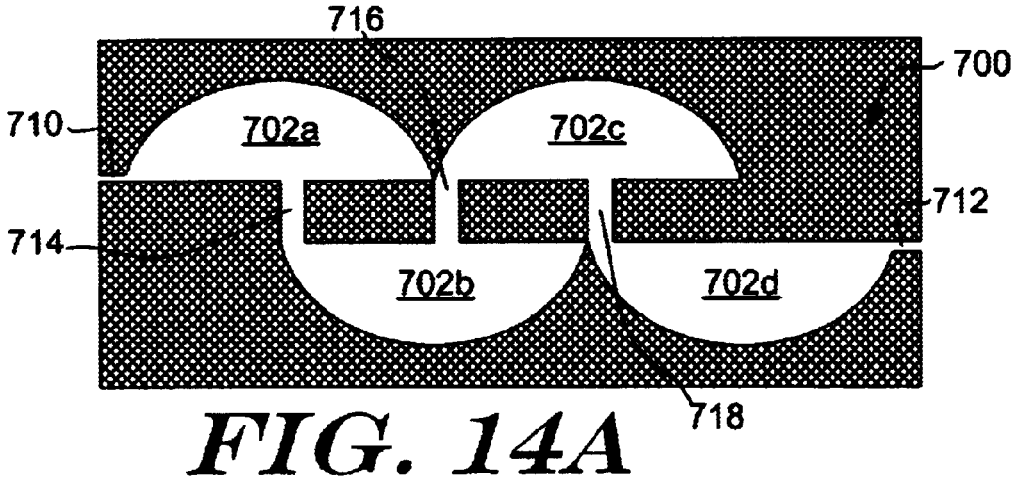
FIGS. 14A–14C are cross-sectional side views of illustrative alignments of multiple cells with interconnecting conduits in a body.
Figure 14B:
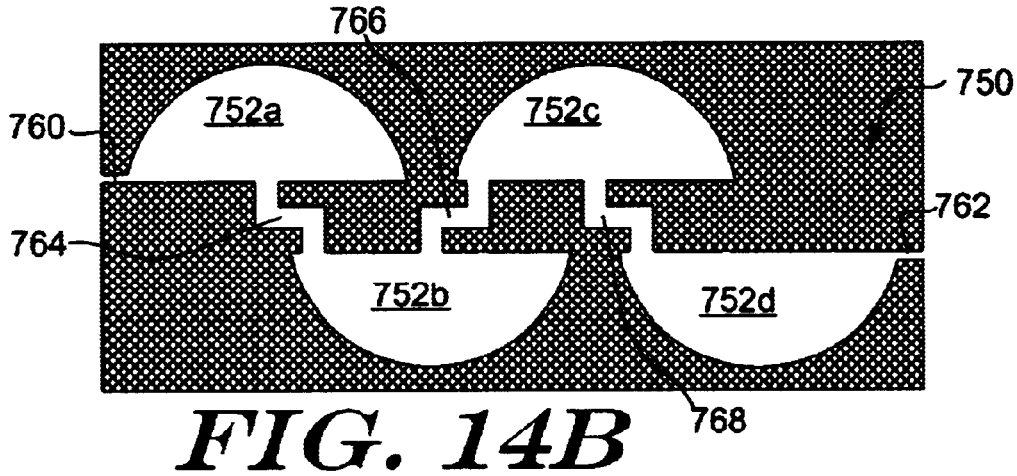
Figure 14C:
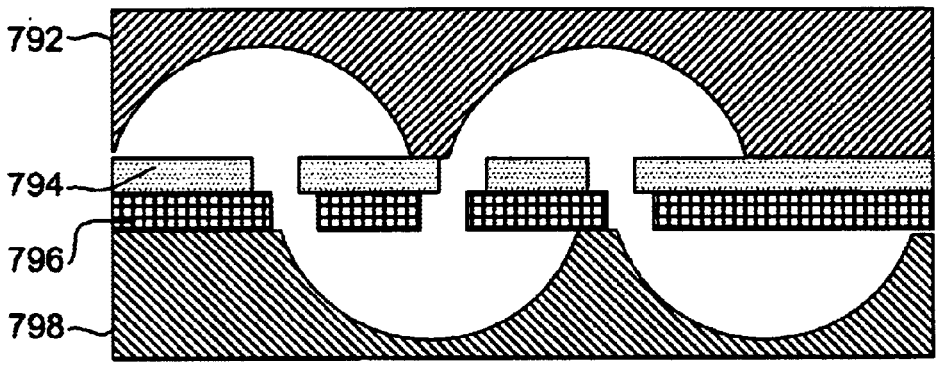

FIGS. 14A, 14B and 14C show illustrative examples in accordance with the present invention of variations on the alignment of chambers and interconnecting conduits within a body. One of the considerations for a functional pump is that the diaphragm may tend to deform in particular ways as it deflects from a position adjacent one wall to a position adjacent another wall. FIGS. 14A, 14B and 14C are best explained when read in conjunction with the diaphragm configurations shown in 15A–15H. In 15A–15D, a diaphragm 810 is shown deflecting from a lower wall to an upper wall, and in FIGS. 15E–15H, a diaphragm 810 is shown deflecting from the upper wall to the lower wall in a chamber 800. The diagrams may be viewed as a sequence beginning from FIG. 15A and ending with FIG. 15H, showing a diaphragm 810 having a tendency to move first near the edge of the chamber 800, and then roll towards the center.

Figure 15A:
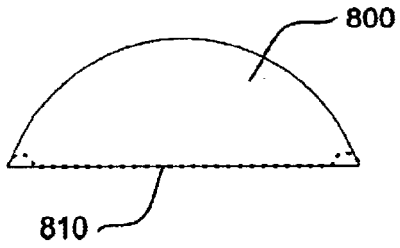
FIGS. 15A–15H are cross-sectional side views of a chamber with a diaphragm deflecting between an upper wall and a lower wall.
Figure 15B:
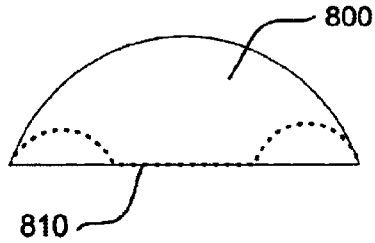
Figure 15C:
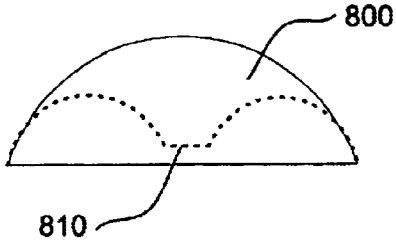
Figure 15D:
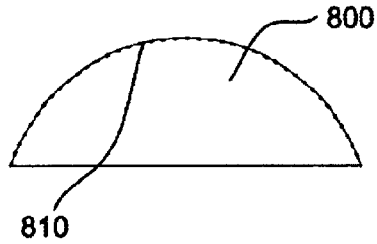
Figure 15E:
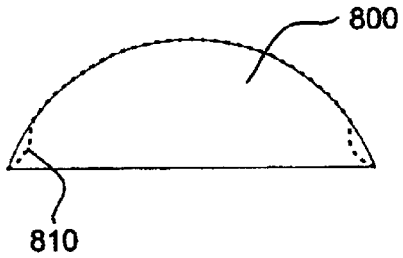
Figure 15F:
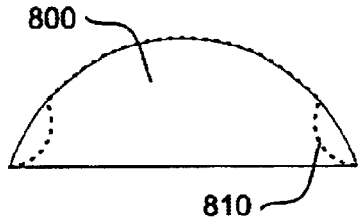
Figure 15G:
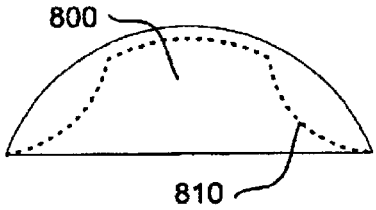
Figure 15H:
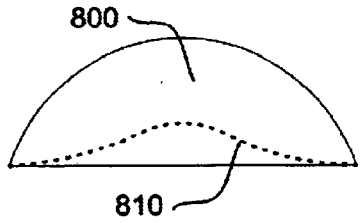

Alternatively, the diagrams may be viewed as a sequence beginning from FIG. 15H and ending with FIG. 15A, showing a diaphragm 810 having a tendency to move first toward the center of the chamber 800 and then rolling toward the edge. Another alternative is to view the sequence going from FIGS. 15A to 15D showing a diaphragm moving from bottom to top, and then from FIGS. 15D to 15A as the same diaphragm moving from top to bottom in generally reversed order. Likewise, one may read the diagrams beginning with FIG. 15H, stopping at FIG. 15D (diaphragm 810 from bottom to top with center moving first) and returning to FIG. 15H, with the same diaphragm 810 moving in a generally reversed order. Other patterns of diaphragm motion are also possible.

In FIG. 14A, a body 700 is shown having four chambers 702*a*, 702*b*, 702*c*, 702*d*, a first horizontal conduit 710, a second horizontal conduit 712, and three interconnecting conduits 714, 716, 718. The diaphragm and electrode configurations explained above may be incorporated into the body 700 to make a functional pump. In the illustrative embodiment of FIG. 14A, a diaphragm having the tendency to move first at the edges and then toward the center as it is deflected from a first wall to an opposing wall may be used. As before, diaphragms may be disposed in each of the four chambers. By offsetting the interconnecting conduits 714, 716, 718 and the chambers 702, 702*b*, 702*c*, 702*d*, the characteristics of deflection of a diaphragm may be more readily accommodated.

For example, if a diaphragm in the first chamber 702*a* deflects toward the edge first, it will tend to open up first horizontal conduit 710 (which is treated as an inlet for this illustrative embodiment) early in the deflection movement (see FIG. 15A) as the diaphragm moves from the lower wall to the upper wall. Once the diaphragm is fully deflected toward the upper wall, the input electric signals may change so that the diaphragm in the first chamber 702*a* begins to deflect downward. As shown in FIG. 15E, the diaphragm may move toward the edges first, cutting off the inlet 710 (FIG. 14A) from fluid communication with the first chamber 702*a*, thereby substantially stopping backflow from the first chamber 702*a*. Then, as shown in FIGS. 15F–H, the diaphragm may close, leaving first interconnecting conduit 714 open to the first chamber 702*a* until the diaphragm has almost completely reached a position adjacent the lower wall of first chamber 702*a*. Similar steps can be repeated for the other chambers, passing the pumped fluid through the chambers and conduits. The pumped fluid would first move in through horizontal conduit 710 into first chamber 702*a*, down through first vertical conduit 714 into second chamber 702*b*, up through second vertical conduit 716 into third chamber 702*c*, down through third vertical conduit 718 into fourth chamber 702*d*, and out through second horizontal conduit 712.

Also, in the case where the diaphragm demonstrates the property that, during deflection from a first wall to an opposing wall, the center moves first and the edges follow, the process for FIG. 14A just described may be reversed. In such an illustrative example, the second horizontal conduit 712 could be an inlet and the first horizontal conduit 710 could be an outlet, with fluid passing through in the opposite order of chambers and conduits.

FIG. 14B shows an alternative configuration performing similar steps. In FIG. 14B, the vertical conduits 764, 766, 768 are slightly more complicated, having an internal bend, but the chambers 752*a*, 752*ab*, 752*c*, 752*d* may be more greatly spaced. FIG. 14C may be used to illustrate one of the many methods of manufacture for a mesopump in accordance with the present invention. FIG. 14C shows that four layers 792, 794, 796, 796 may be etched or otherwise patterned to create the chambers and conduits shown, and then sandwiched together using known methods for securing multiple layers together. Diaphragm layers may also be added in between layers as needed. For example, in FIG. 14C a diaphragm layer may be placed between layers 792 and 794 and/or between layers 796 and 798. One skilled in the art will recognize that other configurations are available and other methods of manufacture may function as well without exceeding the scope of the invention.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A method of pumping a fluid in a pump comprising a body forming at least one chamber having a volume, wherein each chamber includes a diaphragm mounted in said chamber, wherein said diaphragm is mounted and adapted to move within said chamber; the method comprising the steps of:

selecting a diaphragm for actuation;

using an electrostatic force by applying a voltage between two or more electrodes to move the selected diaphragm across more than half of said chamber from a first position to a second position; and using an elastic force to return the selected diaphragm to substantially the first position in said chamber.

2. A method according to claim 1 wherein each step is repeated until every diaphragm in the body has been selected once.

3. A method according to claim 1 comprising the step of using an elastic force to prevent movement of all non-selected diaphragms.

4. A method according to claim 1 further comprising the step of using an electrostatic force to prevent movement of all non-selected diaphragms.

5. A method of pumping a fluid in a pump comprising a body forming at least one chamber having a volume and a first electrode mounted relative to a wall of the chamber, the chamber further having a diaphragm with a second electrode, the method comprising the steps of:

using an electrostatic force by applying a voltage between the first and second electrodes to move the diaphragm to a first position on a first side of said chamber;

using an elastic force to move the diaphragm from the first position to a second position on a second side of said chamber.

6. A method according to claim 5 wherein the fluid being pumped does not pass between the diaphragm and the electrode.

7. A method according to claim 5 wherein the elastic force is generated by a tension applied to the diaphragm.

8. A method according to claim 5 wherein the elastic force is generated by using a diaphragm having a predefined shape and wherein the first position represents a position in which the diaphragm is deformed from the predefined shape.

9. A method of pumping a fluid in a pump comprising a body forming a chamber having a volume wherein the chamber is divided into first and second portions by a center wall, the center wall having a conduit placing the first portion and second portion in fluid communication with each other, a first diaphragm being mounted in said first portion and a second diaphragm being mounted in said second portion, a first electrode fixed relative a wall of the chamber defining part of said first portion, a second electrode fixed relative a wall of the chamber defining part of said second portion, said chamber having an inlet in fluid communication with said first portion and an outlet in fluid communication with said second portion, the method comprising:

drawing fluid into said first portion through said inlet using an electrostatic force by applying a voltage between two or more electrodes including the first electrode to move said first diaphragm from a first position on said center wall to a second position on said chamber wall defining part of said first portion;

drawing fluid into said second portion from said first portion through said conduit; and pushing fluid out of said second portion through said outlet;

wherein the step of drawing fluid into said second portion from said first portion through said conduit includes:

applying an electrostatic force to the second diaphragm by applying a voltage between two or more electrodes including the second electrode to pull said second diaphragm towards the second electrode while applying an elastic force to pull the first diaphragm from the second position to the first position until the first diaphragm covers the inlet, preventing fluid flow through said inlets.

10. A method according to claim 9 wherein the fluid does not pass between the first electrode and the first diaphragm.

11. A method according to claim 9 wherein the step of drawing fluid into said first portion through said inlet includes:

applying an electrostatic force to the first diaphragm to pull said first diaphragm towards the first electrode while applying an elastic force to keep said second diaphragm adjacent said center wall to prevent fluid from passing through said conduit.

12. A method according to claim 9 wherein the step of pushing fluid out of the second portion through the outlet includes:

applying an elastic force to the first diaphragm to keep said first diaphragm adjacent the center wall to prevent fluid from flowing through the conduit while applying an elastic force to the second diaphragm to force the fluid through the outlet.

13. A method of pumping a fluid in a pump having at least a first elementary cell and a second elementary cell, each cell including a diaphragm, the method comprising:

drawing an amount of fluid into the first elementary cell by applying an electrostatic force to the diaphragm in the first elementary cell by providing a voltage between two or more electrodes to move the diaphragm in the first (elementary cell from a first position on one side of the first elementary cell to a second position on another side of the first elementary cell;

drawing the amount of fluid from the first elementary cell into the second elementary cell by applying an electrostatic force to the diaphragm in the second elementary cell by providing a voltage between two or more electrodes, and further applying only an elastic force to the diaphragm in the first elementary cell to move the diaphragm in the first elementary cell from the second position to the first position;

using the diaphragm from the first elementary cell to limit backflow from the second elementary cell into the first elementary cell; and forcing the amount of fluid out of the second elementary cell.

14. A method as in claim 1 wherein the first position is adjacent a first side of said chamber and the second position is adjacent a second side of said chamber.

15. A method of pumping a fluid in a pump comprising a body forming a chamber, wherein the chamber includes a diaphragm mounted in said chamber and adapted to move within said chamber; the method comprising the steps of:

using an electrostatic force by providing a voltage between two or more electrodes to move the selected diaphragm across more than half of said chamber from a first position to a second position, the diaphragm elastically deforming when moved from the first position to the second position; and deactivating the electrostatic force, wherein the diaphragm returns to the first position under elastic restoring forces.

* * * * *